US010025254B2

(12) United States Patent
Nakade

(10) Patent No.: US 10,025,254 B2
(45) Date of Patent: Jul. 17, 2018

(54) IMAGE FORMING APPARATUS AND CONTROL PROGRAM

(71) Applicant: KONICA MINOLTA, INC., Chiyoda-ku, Tokyo (JP)

(72) Inventor: Yohei Nakade, Okazaki (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/440,362

(22) Filed: Feb. 23, 2017

(65) Prior Publication Data

US 2017/0285552 A1 Oct. 5, 2017

(30) Foreign Application Priority Data

Mar. 30, 2016 (JP) ..... 2016-068462

(51) Int. Cl.
*G03G 15/16* (2006.01)
*G03G 15/00* (2006.01)
*G03G 21/14* (2006.01)

(52) U.S. Cl.
CPC ..... *G03G 15/70* (2013.01); *G03G 15/1605* (2013.01); *G03G 15/5004* (2013.01); *G03G 15/5054* (2013.01); *G03G 15/55* (2013.01); *G03G 15/5033* (2013.01); *G03G 15/5041* (2013.01); *G03G 15/5058* (2013.01); *G03G 15/553* (2013.01); *G03G 15/75* (2013.01); *G03G 15/757* (2013.01); *G03G 21/145* (2013.01);

(Continued)

(58) Field of Classification Search
CPC ..... G03G 15/1605; G03G 15/5004; G03G 15/5033; G03G 15/5041; G03G 15/5054; G03G 15/55; G03G 15/5058; G03G 15/553; G03G 15/70; G03G 15/75; G03G 15/757; G03G 21/145; G03G 2215/00029; G03G 2215/00033; G03G 2215/00037; G03G 2215/00042; G03G 2215/00059
See application file for complete search history.

(56) References Cited

U.S. PATENT DOCUMENTS

2011/0013919 A1* 1/2011 Matsuda ..... G03G 15/0136 399/49
2012/0057892 A1* 3/2012 Endoh ..... G03G 15/0189 399/66
2016/0124343 A1* 5/2016 Sakurai ..... G03G 15/105 399/58

FOREIGN PATENT DOCUMENTS

JP 2015-102214 A 6/2015

* cited by examiner

*Primary Examiner* — Joseph S Wong
(74) *Attorney, Agent, or Firm* — Buchanan Ingersoll & Rooney PC

(57) ABSTRACT

An image forming apparatus includes: an image forming unit configured to form an image pattern on a medium, a predetermined image repeatedly appearing in a first cycle in a sub scanning direction in the image pattern; a density detector configured to optically detect a density of the image pattern in the sub scanning direction; a cyclic image detector configured to detect a feature image having a second cycle corresponding to the first cycle in accordance with a result of the detection; and a state determining unit configured to determine whether a cycle depending on an outer circumference of a rotary member included in the image forming apparatus corresponds to the second cycle when the feature image is detected by the cyclic image detector, and determine that a state of the rotary member has deteriorated when the cycle depending on the outer circumference is determined to correspond to the second cycle.

20 Claims, 17 Drawing Sheets

(52) U.S. Cl.
CPC ..... *G03G 2215/00029* (2013.01); *G03G 2215/00033* (2013.01); *G03G 2215/00037* (2013.01); *G03G 2215/00042* (2013.01); *G03G 2215/00059* (2013.01)

FIG. 11

Ta1

| | OUTER CIRCUMFERENCE [mm] | VIBRATION CYCLE [msec] |
|---|---|---|
| PHOTOSENSITIVE MEMBER | 94 | 314 |
| CHARGING ROLLER | 37 | 40 |
| DEVELOPING ROLLER | 56 | 60 |
| ⋮ | ⋮ | ⋮ |

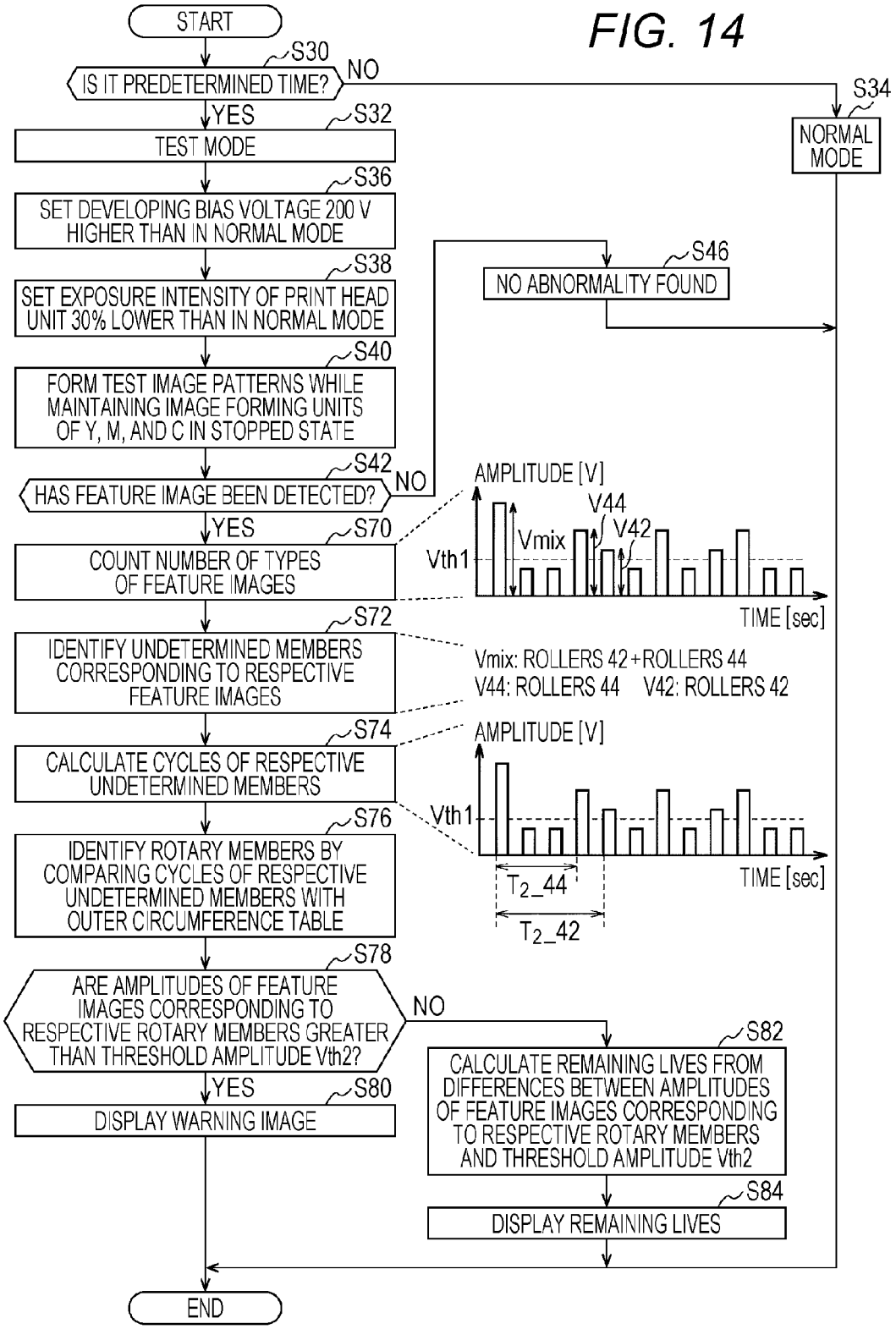
FIG. 14
START
S30
IS IT PREDETERMINED TIME?
NO
YES
S32
TEST MODE
S34
NORMAL MODE
S36
SET DEVELOPING BIAS VOLTAGE 200 V HIGHER THAN IN NORMAL MODE
S38
SET EXPOSURE INTENSITY OF PRINT HEAD UNIT 30% LOWER THAN IN NORMAL MODE
S46
NO ABNORMALITY FOUND
S40
FORM TEST IMAGE PATTERNS WHILE MAINTAINING IMAGE FORMING UNITS OF Y, M, AND C IN STOPPED STATE
S42
HAS FEATURE IMAGE BEEN DETECTED?
NO
YES
S70
COUNT NUMBER OF TYPES OF FEATURE IMAGES
AMPLITUDE [V]
V44
Vmix
V42
Vth1
TIME [sec]
S72
IDENTIFY UNDETERMINED MEMBERS CORRESPONDING TO RESPECTIVE FEATURE IMAGES
Vmix: ROLLERS 42+ROLLERS 44
V44: ROLLERS 44 V42: ROLLERS 42
S74
CALCULATE CYCLES OF RESPECTIVE UNDETERMINED MEMBERS
AMPLITUDE [V]
Vth1
TIME [sec]
T2_44
T2_42
S76
IDENTIFY ROTARY MEMBERS BY COMPARING CYCLES OF RESPECTIVE UNDETERMINED MEMBERS WITH OUTER CIRCUMFERENCE TABLE
S78
ARE AMPLITUDES OF FEATURE IMAGES CORRESPONDING TO RESPECTIVE ROTARY MEMBERS GREATER THAN THRESHOLD AMPLITUDE Vth2?
NO
YES
S80
DISPLAY WARNING IMAGE
S82
CALCULATE REMAINING LIVES FROM DIFFERENCES BETWEEN AMPLITUDES OF FEATURE IMAGES CORRESPONDING TO RESPECTIVE ROTARY MEMBERS AND THRESHOLD AMPLITUDE Vth2
S84
DISPLAY REMAINING LIVES
END

IMAGE FORMING APPARATUS AND CONTROL PROGRAM

The entire disclosure of Japanese Patent Application No. 2016-068462 filed on Mar. 30, 2016 including description, claims, drawings, and abstract are incorporated herein by reference in its entirety.

BACKGROUND OF THE INVENTION

Field of the Invention

This disclosure relates to an image forming apparatus, and more particularly, to an image forming apparatus that determines the state of a rotary member to be rotatively driven.

Description of the Related Art

An image forming apparatus normally includes a large number of rotary members to be rotatively driven, such as conveyance rollers for conveying a medium such as paper sheets. As these rotary members are used for a long time, the bearings and the gears become worn, and the rotary members vibrate harder. In some cases, the rotary members generate noise.

In regard to vibration of such rotary members, JP 2015-102214 A discloses a structure that reduces vibration and noise generated when the drive source is activated, and transmits, with high precision, the torque from the drive source to the components to be driven. More specifically, according to the technology disclosed in JP 2015-102214 A, a potential difference is caused between the conductive portion of the drive pulley and the metal layer of the belt, so that the conductive portion and the metal layer are electrostatically attracted to each other. Furthermore, a potential difference is caused between the conductive portion of the following pulley and the metal layer, so that the conductive portion and the metal layer are electrostatically attracted to each other.

However, the technology disclosed in JP 2015-102214 A relates to the control for reducing the speed of increase in vibration of a rotary member, but is not a technology for preventing vibration. Therefore, the vibration of a rotary member gradually becomes larger as the rotary member is used. Eventually, the vibration causes errors such as defective images. A rotary member that is broken due to large vibration often leads to failures in other members. In view of this, it is preferable to monitor the state of a rotary member, and replace the rotary member before the rotary member is broken.

SUMMARY OF THE INVENTION

The present disclosure has been made to solve the above problems, and an object in one aspect thereof is to provide an image forming apparatus capable of accurately monitoring the state of a rotary member to be rotatively driven, and a control program to be used in the image forming apparatus.

To achieve the abovementioned object, according to an aspect, an image forming apparatus reflecting one aspect of the present invention comprises: an image forming unit configured to form an image pattern on a medium, a predetermined image repeatedly appearing in a first cycle in a sub scanning direction in the image pattern; a density detector configured to optically detect a density of the image pattern in the sub scanning direction; a cyclic image detector configured to detect a feature image having a second cycle corresponding to the first cycle, in accordance with a result of the detection performed by the density detector; and a state determining unit configured to determine whether a cycle depending on an outer circumference of a rotary member included in the image forming apparatus corresponds to the second cycle when the feature image is detected by the cyclic image detector, and determine that a state of the rotary member has deteriorated when the cycle depending on the outer circumference is determined to correspond to the second cycle.

The cyclic image detector preferably calculates a reference density from the result of the detection performed by the density detector. The second cycle preferably includes a period during which an amplitude of the density of the image pattern based on the reference density is greater than a first amplitude.

The second cycle preferably includes a period during which substantially the same amplitude is detected from the amplitude of the density of the image pattern greater than the first amplitude.

The predetermined image preferably includes a uniform image formed over a period in the first cycle.

The predetermined image preferably includes an image having a density continuously changing at least over a period in the first cycle.

The reference density preferably includes the lowest density in the density of the image pattern over a predetermined period, the predetermined period being longer than the first cycle.

The reference density preferably includes a mean density of a non-image area excluding an area in which the uniform image is formed in a predetermined period, the predetermined period being longer than the first cycle.

When determining that the cycle depending on the outer circumference of the rotary member corresponds to the second cycle, the state determining unit preferably determines that the rotary member has deteriorated to a greater extent as an amplitude of a density of the feature image is greater.

When the amplitude of the density of the feature image exceeds a second amplitude, the state determining unit preferably determines that the life of the rotary member has come to an end.

The image forming unit preferably forms the image pattern on a medium at different printing speeds. The state determining unit preferably determines the state of the rotary member in accordance with an amplitude of a feature image having the greatest amplitude among feature images detected at the different printing speeds.

The image forming apparatus preferably further comprises a display unit configured to present information to a user. When determining that the life of the rotary member has come to an end, the state determining unit preferably causes the display unit to display a warning.

The image forming apparatus preferably further comprises a storage unit storing information related to outer circumferences of a plurality of rotary members included in the image forming apparatus. When the cyclic image detector detects the feature image, the state determining unit preferably compares the second cycle with cycles corresponding to the respective outer circumferences of the rotary members, and determines that a state of a rotary member corresponding to the second cycle among the rotary members has deteriorated.

The image forming apparatus preferably further comprises a processor configured to be capable of switching between a normal mode for printing out input image data and a test mode for determining the state of the rotary member. In the test mode, the processor preferably forms the image pattern on a medium under a different printing condition from the normal mode.

The processor preferably switches to the test mode at a predetermined time.

The image forming apparatus preferably further comprises: an image carrier configured to carry a latent image; and an exposure device configured to expose the image pattern on the image carrier. The image forming unit preferably includes a developer carrier, and develops the image pattern on the image carrier by applying a developing bias voltage to the developer carrier and supplying a developer to the latent image corresponding to the image pattern. In the test mode, the processor preferably performs at least one of a control operation to reduce a light intensity of the exposure device to a smaller value than in the normal mode, and a control operation to set the developing bias voltage at a greater value than in the normal mode.

A spot diameter of a light flux emitted from the density detector is preferably smaller than a value obtained by dividing a cycle equivalent to the least common multiple between the first cycle and the cycle depending on the outer circumference of the rotary member by a surface velocity of the rotary member.

The image forming unit preferably forms the image pattern on a medium by an electrophotographic method.

To achieve the abovementioned object, according to an aspect, there is provided a non-transitory recording medium storing a computer readable control program to be executed by a computer of an image forming apparatus to determine a state of a rotary member included in the image forming apparatus, and the control program reflecting one aspect of the present invention causes the computer to execute: a step of causing an image forming unit to form an image pattern on a medium, a predetermined image repeatedly appearing in a first cycle in a sub scanning direction in the image pattern; a step of causing an optical sensor to optically detect a density of the image pattern in the sub scanning direction; a step of determining whether a feature image having a second cycle corresponding to the first cycle is detected, in accordance with a result of the detection performed by the optical sensor; a step of determining whether a cycle depending on an outer circumference of the rotary member corresponds to the second cycle, when the feature image is detected in the second cycle; and a step of determining that the state of the rotary member has deteriorated, when the cycle depending on the outer circumference of the rotary member is determined to correspond to the second cycle.

To achieve the abovementioned object, according to an aspect, an image forming method reflecting one aspect of the present invention comprises: an image forming step of forming an image pattern on a medium, a predetermined image repeatedly appearing in a first cycle in a sub scanning direction in the image pattern; a density detecting step of optically detecting a density of the image pattern in the sub scanning direction; a cyclic image detecting step of detecting a feature image having a second cycle corresponding to the first cycle, in accordance with a result of the detection performed in the density detecting step; and a state determining step of determining whether a cycle depending on an outer circumference of a rotary member included in the image forming apparatus corresponds to the second cycle when the feature image is detected in the cyclic image detecting step, and determining that a state of the rotary member has deteriorated when the cycle depending on the outer circumference is determined to correspond to the second cycle.

To achieve the abovementioned object, according to an aspect, a control method for determining a state of a rotary member included in an image forming apparatus, reflecting one aspect of the present invention comprises: a step of causing an image forming unit to form an image pattern on a medium, a predetermined image repeatedly appearing in a first cycle in a sub scanning direction in the image pattern; a step of causing an optical sensor to optically detect a density of the image pattern in the sub scanning direction; a step of determining whether a feature image having a second cycle corresponding to the first cycle is detected, in accordance with a result of the detection performed by the optical sensor; a step of determining whether a cycle depending on an outer circumference of the rotary member corresponds to the second cycle, when the feature image is detected in the second cycle; and a step of determining that the state of the rotary member has deteriorated, when the cycle depending on the outer circumference of the rotary member is determined to correspond to the second cycle.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 11 is a diagram for explaining an outer circumference table according to the second embodiment;

FIG. 14 is a flowchart for explaining a feature image detection method according to the third embodiment;

DESCRIPTION OF THE PREFERRED EMBODIMENTS

Figure 1A:
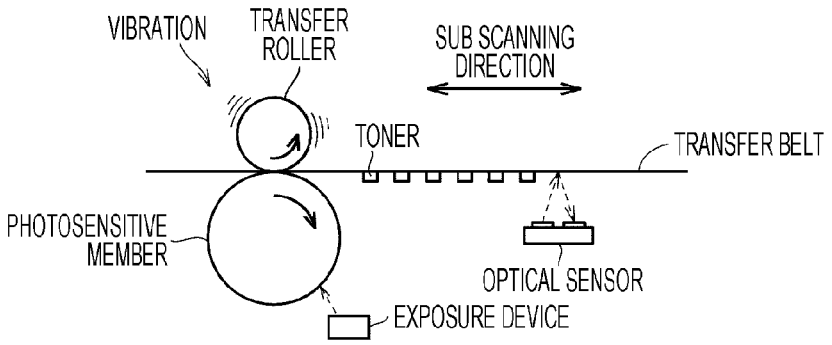
FIGS. 1A through 1E are diagrams for explaining the outline of the control to be performed to monitor the state of a rotary member included in an image forming apparatus according to an embodiment.

Hereinafter, an embodiment of the present invention will be described in detail with reference to the drawings. However, the scope of the invention is not limited to the illustrated examples. In the drawings, the same or similar portions bear the same reference numerals, and explanation thereof will not be repeated.

A. Outline

FIGS. 1A through 1E are diagrams for explaining the outline of the control to be performed to monitor the state of a rotary member included in an image forming apparatus according to an embodiment. As shown in FIG. 1A, the image forming apparatus includes a photosensitive member, an exposure device, and a transfer roller that faces the photosensitive member via a transfer belt. The image forming apparatus also includes a density sensor that optically measures the density of a toner image transferred onto the transfer belt.

The exposure device exposes the test image patterns (hereinafter also referred to as the "image patterns") shown in FIG. 1B, on the photosensitive member. The image patterns are formed with unit data repeatedly appearing in the sub scanning direction in cycles T1. The unit data is formed with uniform image areas (the areas onto which toner is applied) and non-image areas (the areas onto which no toner is applied).

In the example shown in FIG. 1A, the transfer roller is vibrating due to wear of a gear or the like. FIG. 1C is a diagram for explaining the vibration of the transfer roller. As shown in FIG. 1C, the transfer roller is vibrating in cycles Tv. Each cycle Tv is represented by a value obtained by dividing the outer circumference of the transfer roller by the rotating velocity of the transfer roller. The amplitude of the vibration of the transfer roller becomes greater as the transfer roller is used over a period.

Figures 1B, 1C, 1D, 1E:
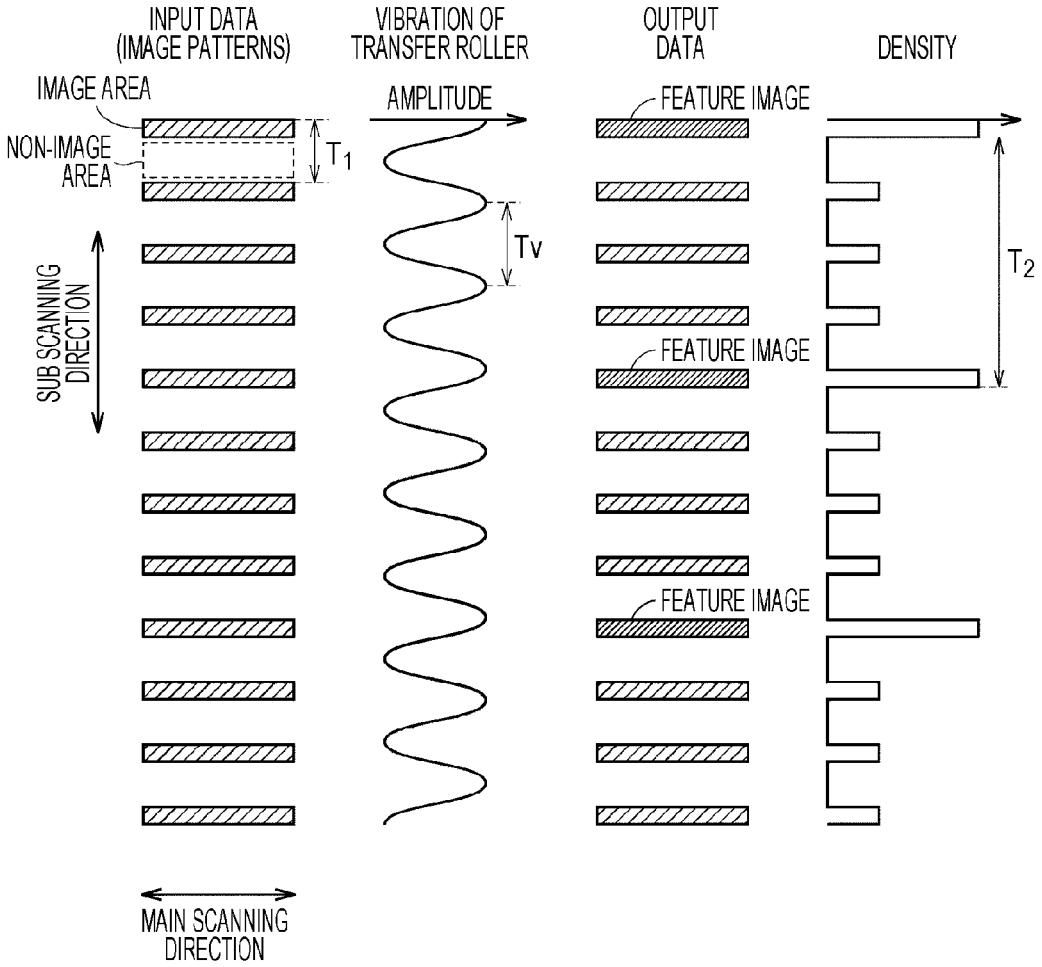

FIG. 1D shows toner images (output data) that are formed on the transfer belt while the transfer roller is greatly vibrating, and correspond to the image patterns. As shown in FIGS. 1B and 1D, the output data differs from the image patterns as the input data. This is because interference occurs and the image density becomes higher when the time at which the amplitude of vibration of the transfer roller becomes larger overlaps the time at which an image area in the image patterns is formed on the photosensitive member. The interference occurs in a cycle equivalent to the least common multiple between the cycle Tv in which the transfer roller vibrates and the cycle T1 in which an image area is formed. Hereinafter, the image areas that have a higher density due to interference between vibration of a rotary member (such as the transfer roller) being rotatively driven and the image patterns will be also referred to as the "feature images".

The image forming apparatus according to the embodiment determines the state of a rotary member such as the transfer roller, taking advantage of the characteristics that cause interference between vibration of the rotary member being rotatively driven and the image patterns. FIG. 1E is a diagram for explaining changes in the density in the sub scanning direction of the output data. The changes in the density are measured with the density sensor. In accordance with a result of the detection performed by the density sensor, the image forming apparatus calculates a cycle T2 in which a feature image is detected. The image forming apparatus then determines whether the calculated cycle T2 corresponds to the cycle Tv in which the transfer roller vibrates. More specifically, when the value obtained by dividing the cycle T2 by the cycle Tv is an integer or a value close to an integer, the image forming apparatus determines that the cycle T2 corresponds to the cycle Tv. When determining that the cycle T2 corresponds to the cycle Tv, the image forming apparatus determines that the transfer roller has deteriorated.

As described above, interference occurs in a cycle equivalent to the least common multiple between the cycle in which the rotary member vibrates and the cycle T1. Therefore, when a cycle generated by multiplying the cycle Tv in which the transfer roller vibrates by an integer matches the cycle T2 in which a feature image is generated (the cycle in which interference is caused), the interference can be assumed to have been caused by vibration of the transfer roller among the rotary members included in the image forming apparatus. When determining that the cycle T2 does not correspond to the cycle Tv, on the other hand, the image forming apparatus determines that the transfer roller is not greatly vibrating and has not deteriorated.

As described above, the image forming apparatus according to the embodiment can determine the state of a rotary member in the image forming apparatus by comparing the vibration cycles of the rotary member with the cycles in which interference occurs.

Further, a density sensor that measures a toner density on the transfer belt is normally installed in an image forming apparatus, to control image density. Accordingly, any additional sensor or the like for detecting the state of a rotary member does not need to be installed in the image forming apparatus according to the embodiment. Without such an additional sensor, the image forming apparatus can determine the state of the rotary member. In the description below, the configuration of and the control on this image forming apparatus will be described in detail.

B. First Embodiment: Determining a State by Comparing the Interference Cycle and the Vibration Cycle of a Rotary Member (b1. Image Forming Apparatus 100)

Figure 2:
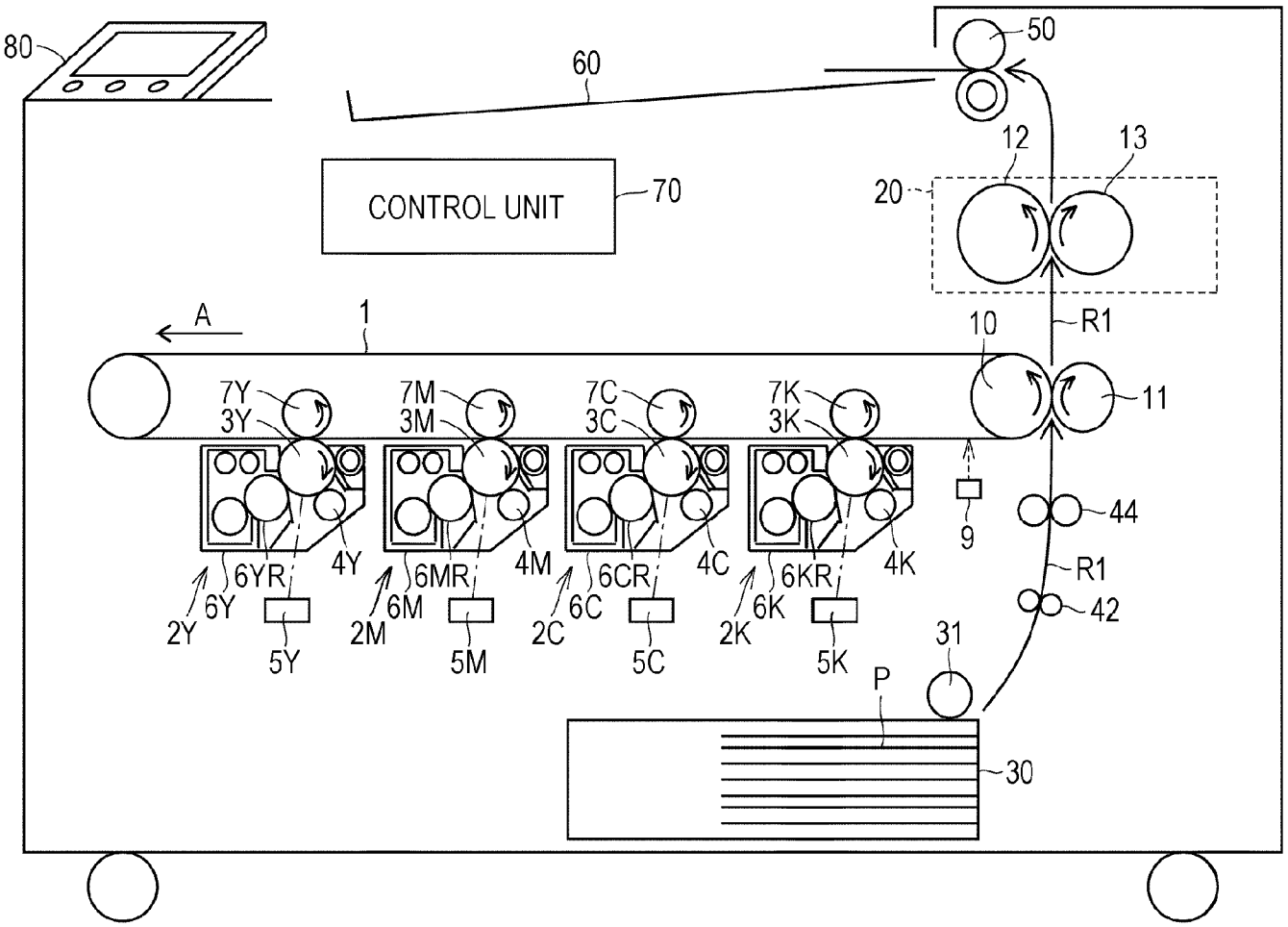
FIG. 2 is a diagram for explaining an example configuration of an image forming apparatus according to a first embodiment.

FIG. 2 is a diagram showing an example configuration of an image forming apparatus 100 according to a first embodiment. The image forming apparatus 100 is an electrophotographic image forming apparatus, such as a laser printer or an LED printer. As shown in FIG. 2, the image forming apparatus 100 includes an intermediate transfer belt 1 as a belt member substantially at the central portion of the inside thereof. Under the lower horizontal portion of the intermediate transfer belt 1, four image forming units 2Y, 2M, 2C, and 2K corresponding to the respective colors, yellow (Y), magenta (M), cyan (C), and black (K), are arranged side by side along the intermediate transfer belt 1. The image forming units 2Y, 2M, 2C, and 2K include rotatable photosensitive members 3Y, 3M, 3C, and 3K, respectively.

Around the respective photosensitive members 3Y, 3M, 3C, and 3K serving as image carriers, charging rollers 4Y, 4M, 4C, and 4K, print head units 5Y, 5M, 5C, and 5K, and developing devices 6Y, 6M, 6C, and 6K corresponding to respective developing rollers 6YR, 6MR, 6CR, and 6KR, and primary transfer rollers 7Y, 7M, 7C, and 7K facing the respective photosensitive members 3Y, 3M, 3C, and 3K via the intermediate transfer belt 1 are arranged in this order in the rotating direction of the photosensitive members 3Y, 3M, 3C, and 3K. Further, a density sensor 9 that optically measures the density of a toner image formed on the intermediate transfer belt 1 is disposed on the downstream side of the image forming unit 2K.

A secondary transfer roller 11 is pressed against the portion of the intermediate transfer belt 1 supported by an intermediate transfer belt driving roller 10, and secondary transfer is performed in this area. A fixing device 20 including a fixing roller 12 and a pressure roller 13 are disposed at a position on the downstream side of a conveyance path R1 behind the secondary transfer area.

A sheet feed cassette 30 is detachably provided in a lower portion of the image forming apparatus 100. Paper sheets P stacked and stored in the sheet feed cassette 30 are sent into the conveyance path R1 one by one, starting from the uppermost one, by virtue of rotation of a sheet feed roller 31. The paper sheets P are then conveyed by rollers 42 and rollers 44. A sheet catch tray 60 and a display unit 80 are provided at an upper portion of the image forming apparatus 100.

In this embodiment, the image forming apparatus 100 uses a tandem intermediate transfer method, for example, but may use some other method. Specifically, the image forming apparatus 100 may be an electrophotographic image forming apparatus that uses a cycle method, or may be an image forming apparatus that uses a direct transfer method of transferring toner from the developing device directly to a paper sheet. Alternatively, the image forming apparatus 100 may be an image forming apparatus according to a so-called inkjet method.

(b2. Outline of Operation of the Image Forming Apparatus 100)

Next, the outline of operation of the image forming apparatus 100 having the above described structure is described. A control unit 70 controls the entire operation of the image forming apparatus 100. When an image signal is input from an external device (a personal computer, for example), the control unit 70 generates a digital image signal by converting the input image signal into yellow, cyan, magenta, and black, and performs exposure by causing the respective print head units 5Y, 5M, 5C, and 5K of the image forming units 2Y, 2M, 2C, and 2K to emit light in accordance with the input digital image signal.

Consequently, electrostatic latent images formed on the respective photosensitive members 3Y, 3M, 3C, and 3K are developed to form toner images in the respective colors by the respective developing rollers 6YR, 6MR, 6CR, and 6KR supplying toner. By the action of the primary transfer rollers 7Y, 7M, 7C, and 7K, the toner images in the respective colors are sequentially superimposed on the intermediate transfer belt 1 moving in the direction of an arrow A shown in FIG. 2. Thus, primary transfer is completed.

The toner images formed on the intermediate transfer belt 1 in this manner are collectively transferred onto a paper sheet P by the action of the secondary transfer roller 11. Thus, secondary transfer is completed.

The toner image transferred onto the paper sheet P through the secondary transfer then reaches the fixing device 20. The toner image is fixed to the paper sheet P by the fixing device 20. The paper sheet P having the toner image fixed thereto is discharged onto the sheet catch tray 60 through a discharge roller 50.

Further, when adjusting image density, the image forming apparatus 100 prints a patch image for density adjustment, and adjusts the charging bias voltage to be applied to the charging rollers 4Y, 4M, 4C, and 4K, and the developing bias voltage to be applied to the developing rollers 6YR, 6MR, 6CR, and 6KR, in accordance with a result of measurement carried out on the patch image by the density sensor 9. By doing so, the image forming apparatus 100 reduces unevenness in the image density.

(b3. Control Unit 70)

Figure 3:
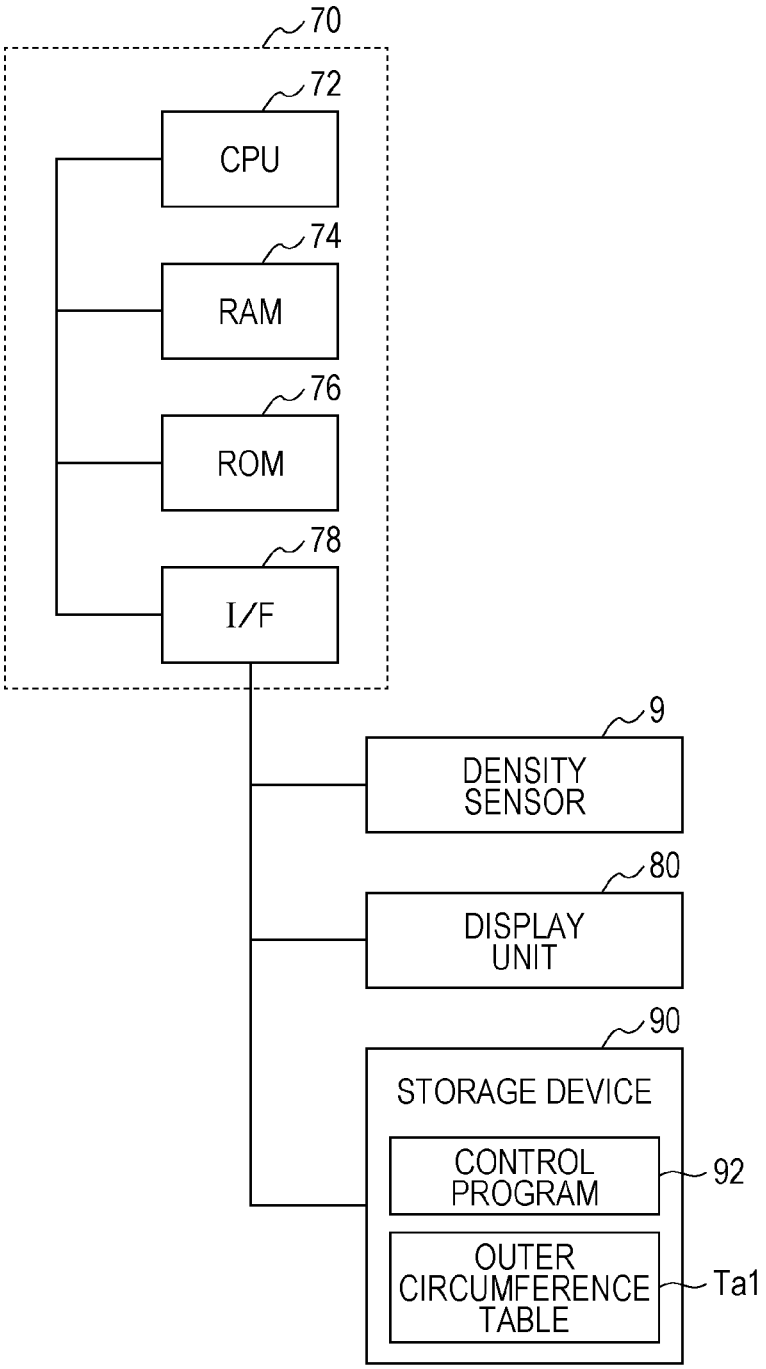
FIG. 3 is a diagram for explaining the hardware configuration of a control unit and peripheral devices according to the first embodiment.

Next, the control unit 70 is described. FIG. 3 is a diagram for explaining the hardware configuration of the control unit 70 and the peripheral devices according to the first embodiment. As shown in FIG. 3, the control unit 70 includes, as its primary control components, a central processing unit (CPU) 72, a random access memory (RAM) 74, a read only memory (ROM) 76, and an interface (I/F) 78.

The CPU 72 performs processing in the entire image forming apparatus 100 by reading and executing a program stored in the ROM 76. The CPU 72 may be a microprocessor, a field programmable gate array (FPGA), an application specific integrated circuit (ASIC), a digital signal processor (DSP), or a circuit having any other calculation function.

The RAM 74 is typically a dynamic random access memory (DRAM) or the like, and temporarily stores the data necessary for the CPU 72 to execute a program, and image data. In other words, the RAM 74 functions as a working memory.

The ROM 76 is typically a flash memory or the like, and stores the programs to be executed by the CPU 72 and various kinds of setting information related to the operation of the image forming apparatus 100.

The interface 78 is electrically connected to the density sensor 9, the display unit 80, and a storage device 90, and exchanges signals with various devices. The storage device 90 stores a control program 92 for controlling the image forming apparatus 100, and an outer circumference table Ta1, which will be described later.

(b4. Vibration of a Rotary Member)

FIGS. 4A through 4D are diagrams (part 1) for explaining the relationship between vibration of the rotary member and feature images. The control unit 70 according to this embodiment uses the image patterns shown in FIG. 4A in detecting the state of the rotary member. An example of the image patterns is generated by repeatedly forming unit data of 20 mm in the main scanning direction and 2.1 mm in the sub scanning direction in T1 cycles. In the sub scanning direction, the unit data is 5-on 45-off data (a 5-dot image area, followed by a 45-dot non-image area) at 600 dpi.

The spot diameter of a light flux emitted from the density sensor 9 is preferably smaller than each of the intervals at which interference occurs between an image pattern and vibration of the rotary member having its state being determined, or the value obtained by dividing a cycle equivalent to the least common multiple between a cycle T1 and a cycle of vibration of the rotary member (this cycle is also referred to as a "vibration cycle") by the surface velocity of the rotary member. This is to accurately determine the state of the rotary member. The spot diameter of the density sensor 9 is 2 mm, for example.

Figures 4A, 4B, 4C, 4D:
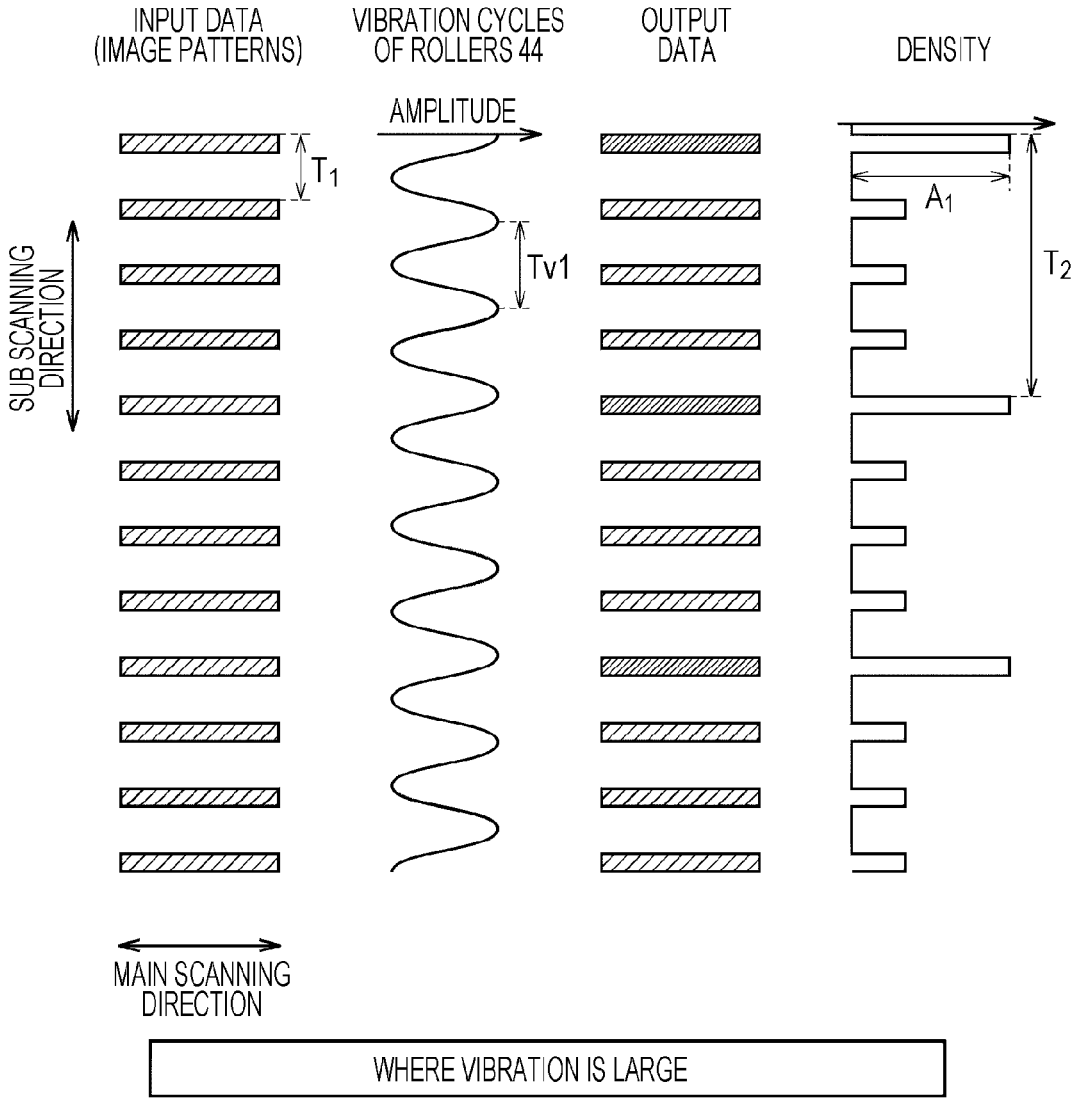
FIGS. 4A through 4D are diagrams (part 1) for explaining the relationship between vibration of a rotary member and feature images.
Figure 5:
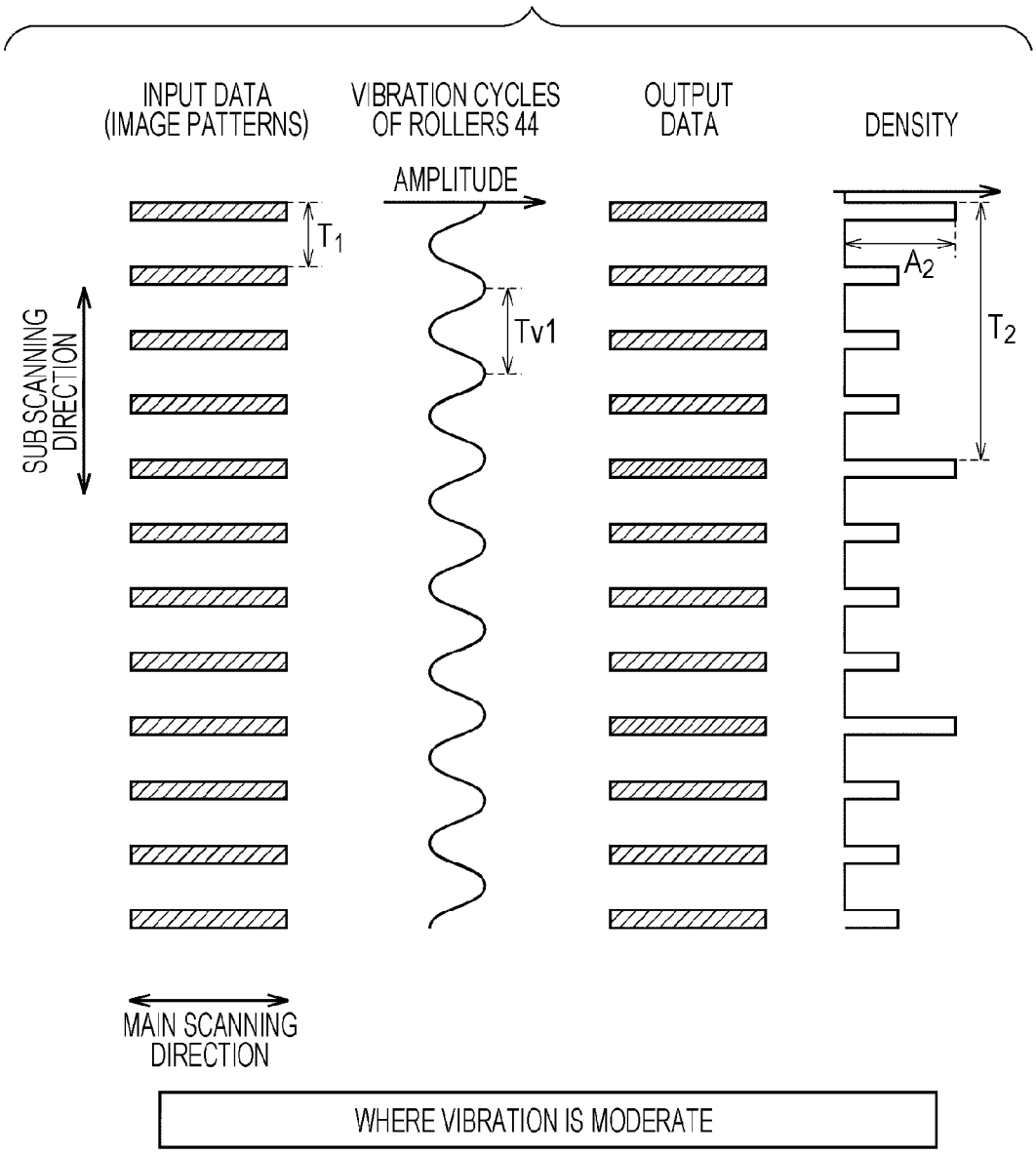
FIG. 5 is a diagram (part 2) for explaining the relationship between vibration of a rotary member and feature images.
Figure 6:
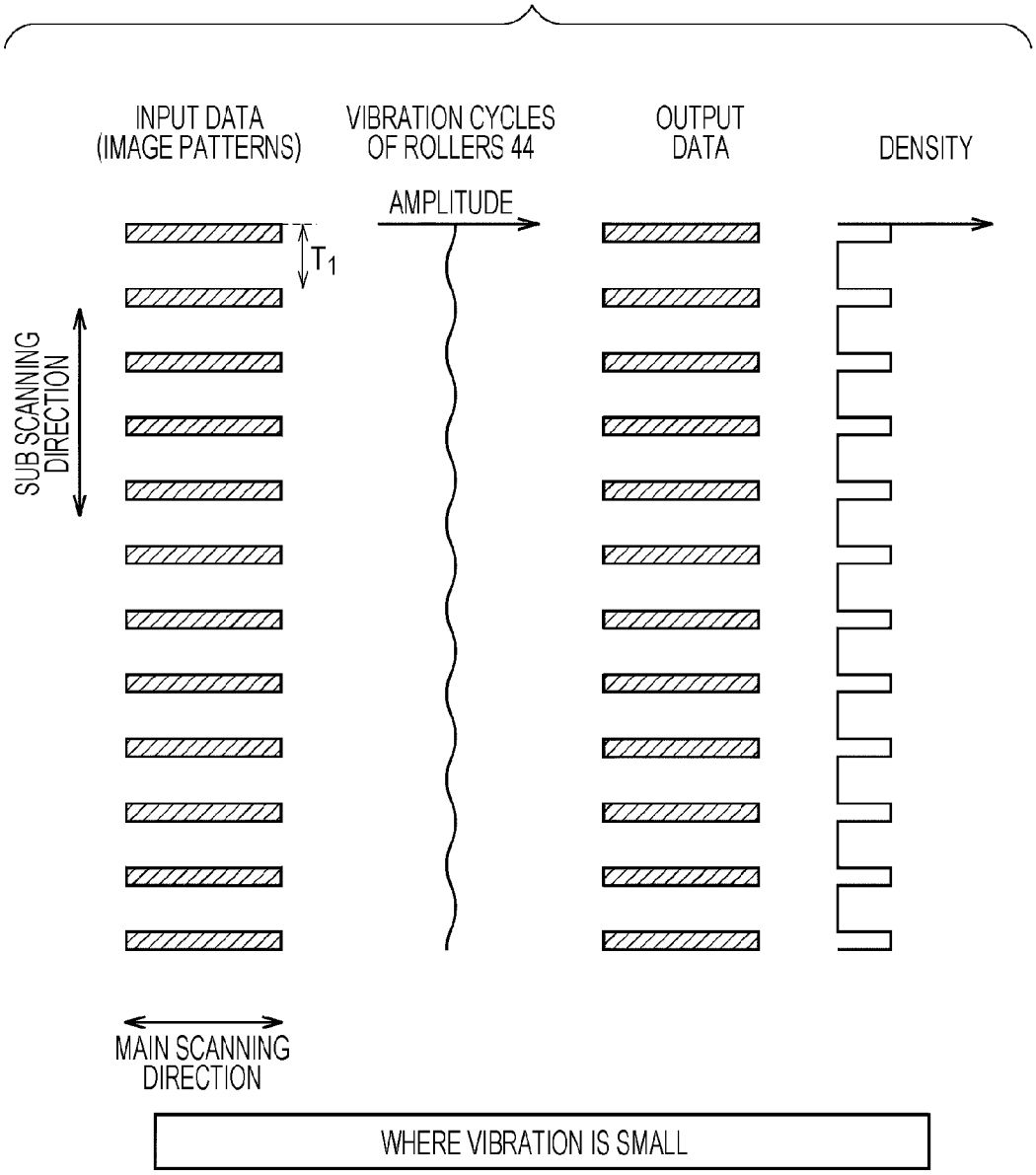
FIG. 6 is a diagram (part 3) for explaining the relationship between vibration of a rotary member and feature images.

In the example shown in FIG. 4B, the rollers 44 as an example of the rotary member are greatly vibrating. Therefore, interference occurs in a cycle T2, which is the least common multiple between a vibration cycle Tv1 of the rollers 44 and a cycle T1, as shown in FIG. 4C, and feature images appear. As shown in FIG. 4D, the amplitude A1 of the density of each feature image to be detected by the density sensor 9 becomes larger as the vibration (or the amplitude) of the rollers 44 becomes larger. Therefore, in a case where the vibration of the rollers 44 is moderate, as shown in FIG. 5, the amplitude A2 of the density of each feature image becomes smaller than the amplitude A1. Further, in a case where the vibration of the rollers 44 is sufficiently small, as shown in FIG. 6, no interference occurs between the vibration of the rollers 44 and the image patterns, and therefore, any feature image does not appear.

(b5. Detection of Feature Images)

Figure 7:
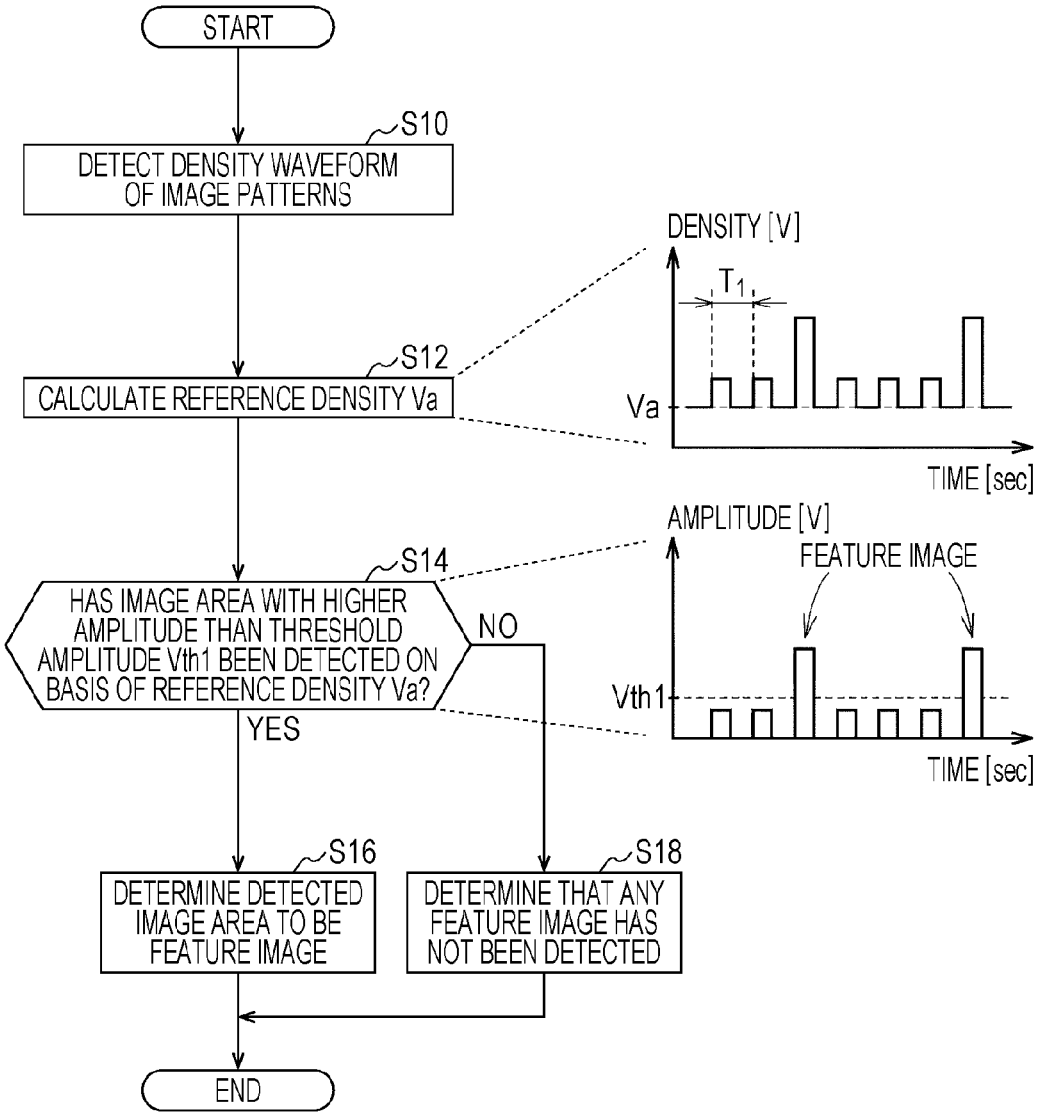
FIG. 7 is a flowchart for explaining a feature image detection method according to an embodiment.

FIG. 7 is a flowchart for explaining a feature image detection method according to this embodiment. The process shown in FIG. 7 is performed by the control unit 70 executing the control program 92 stored in the storage device 90. In another aspect of the present technology, part of or all of the process may be performed by a circuit element or some other hardware. It should be noted that these conditions apply in the processes shown in the flowcharts to be explained later.

As shown in FIG. 7, in step S10, the control unit 70 receives the density waveform of the image patterns from the density sensor 9. In step S12, the control unit 70 calculates a reference density Va from the density waveform of the image patterns in calculating the amplitude of feature images. More specifically, the lowest density in a predetermined period is set as the reference density Va. The predetermined period is longer than each cycle T1 in which an image area is formed, and is 30 times longer than each cycle T1, for example. In another aspect of the present technology, the control unit 70 may use a reference density that is the mean density in the non-image areas in the predetermined period.

In step S14, the control unit 70 calculates a density difference (amplitude) by subtracting the reference density Va from the density of the image pattern, and determines whether an image area with a greater amplitude than a threshold amplitude Vth1 has been detected. For example, the threshold amplitude Vth1 is 1.2 times greater than the mean density in the image area in the predetermined period. The mean density is measured in a state where the number of paper sheets printed by the image forming apparatus 100 is less than 100000 sheets (or where the rotary member of the image forming apparatus 100 have not been used too many times).

If it is determined that an image area with an amplitude greater than the threshold amplitude Vth1 has been detected (YES in step S14), the control unit 70 determines the image area to be a feature image (step S16). If it is determined that any image area with an amplitude greater than the threshold amplitude Vth1 has not been detected (NO in step S14), on the other hand, the control unit 70 determines that any feature image has not been detected (step S18).

As described above, the image forming apparatus 100 according to this embodiment can detect a feature image in which vibration of a rotary member of the image forming apparatus 100 and an image pattern interfere with each other.

It should be noted that, in the example described above, the control unit 70 determines whether the amplitude based on the reference density Va is greater than the threshold amplitude Vth1, in detecting a feature image. However, the present technology is not limited to that. In another aspect of the present technology, the control unit 70 may be designed to determine that an image area with a higher toner density than a predetermined value is a feature image. However, the density of an image pattern varies with the environment (such as temperature and humidity) of the image forming apparatus 100. Therefore, the feature images can be detected with higher precision when each feature image is detected in accordance with a density difference (amplitude) from the reference density.

(b6. Determination on the State of a Rotary Member)

Figure 8:
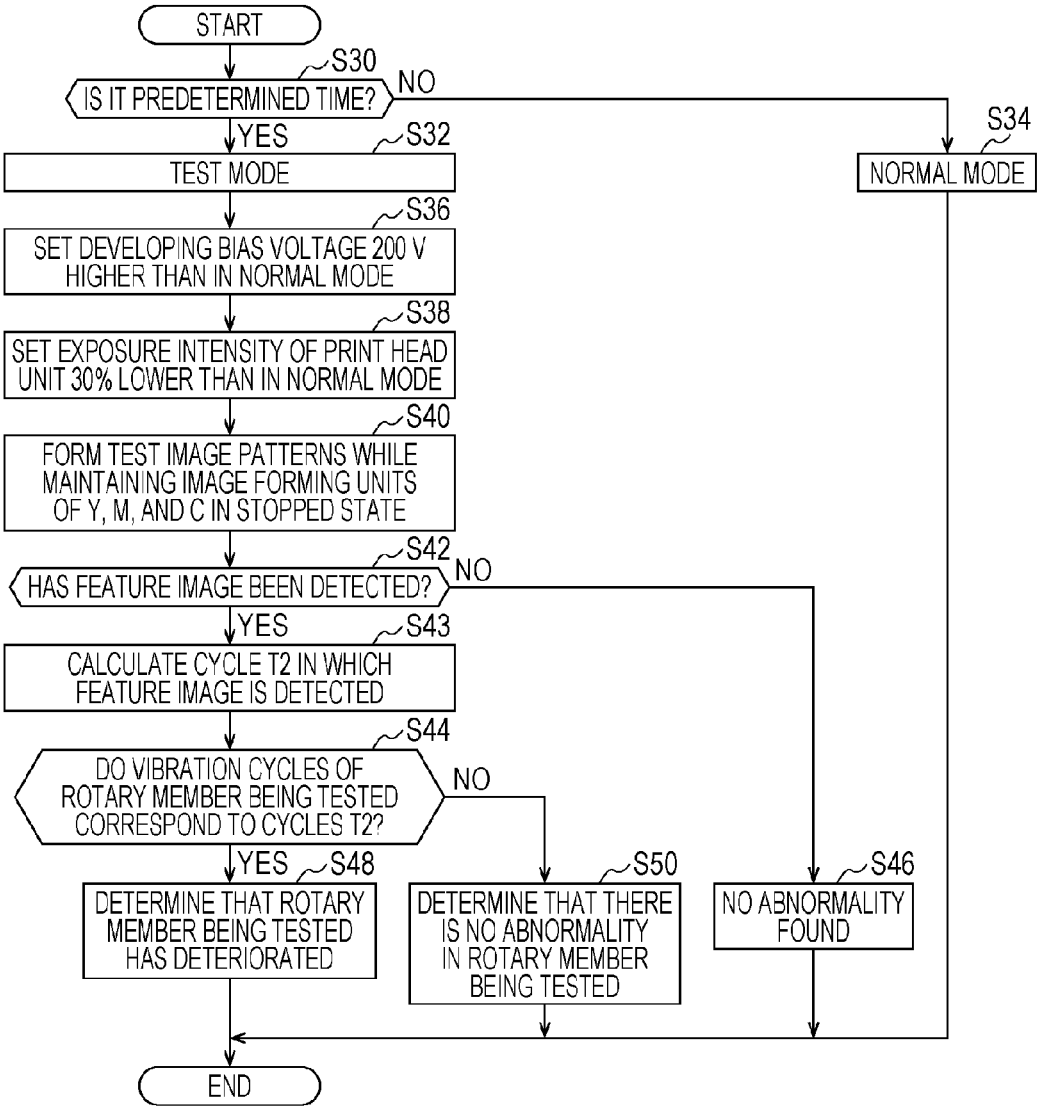
FIG. 8 is a flowchart for explaining the control to be performed to determine the state of a rotary member of the image forming apparatus according to the first embodiment.

FIG. 8 is a flowchart for explaining the control to be performed to determine the state of a rotary member of the image forming apparatus 100 according to the first embodiment. In the example shown in FIG. 8, the control unit 70 determines the state of the black photosensitive member 3K as a rotary member. As shown in FIG. 8, the control unit 70 in step S30 determines whether a predetermined time has come. The predetermined time may be a time when power is applied to the image forming apparatus 100, for example. In another aspect of the present technology, the predetermined time may be a time when the number of printed paper sheets exceeds a predetermined value. In yet another aspect of the present technology, the predetermined time may be a time when the environment of the image forming apparatus 100 satisfies a predetermined condition. For example, the predetermined condition is that there is a temperature change of 5° C. or greater and/or a humidity change of 10% RH or greater since the last time the state of the rotary member was determined. The predetermined time may be a time determined by appropriately combining the above described examples.

If it is determined that the predetermined time has come (YES in step S30), the control unit 70 moves on to step S32, and switches the operation mode from a normal mode for printing out input image data, to a test mode for determining the state of a rotary member. If it is determined that the predetermined time has not come (NO in step S30), on the other hand, the control unit 70 moves on to step S34, and maintains the normal mode.

In step S36, the control unit 70 sets the developing bias voltage to be applied to the developing roller 6KR at a voltage 200 V higher than that in the normal mode. In step S38, the control unit 70 sets the exposure intensity of the print head unit 5K at a value 30% lower than that in the normal mode. By virtue of the control performed in steps S36 and S38, the difference in brightness between the feature image and the other portions becomes more pronounced. Accordingly, under the above condition, the control unit 70 can detect feature images with higher precision than that under the printing condition in the normal mode.

In step S40, the control unit 70 forms test image patterns with the image forming unit 2K, while maintaining the image forming units 2Y, 2M, and 2C in a stopped state. This is because the outer circumferences of the photosensitive members 3Y, 3M, 3C, and 3K are the same, or the cycles in which the respective photosensitive members vibrate are the same. In a case where an image pattern is formed while a photosensitive member of a color other than black is driven (is vibrating), the control unit 70 cannot identify which photosensitive member's vibration cycle has interfered with the image pattern even if the feature image generated due to the interference is detected. Therefore, in the test mode, the control unit 70 forms an image pattern while only one image forming unit is driven. In the example shown in FIG. 8, to determine the state of the photosensitive member 3K, the control unit 70 forms an image pattern by driving only the image forming unit 2K including the photosensitive member 3K.

In step S42, the control unit 70 determines whether a feature image has been detected according to the flowchart shown in FIG. 7. If it is determined that any feature image has not been detected (NO in step S42), the control unit 70 determines that there is no abnormality in the rotary member in the image forming apparatus 100, except for the rotary members forming the image forming units 2Y, 2M, and 2C (step S46).

If it is determined that a feature image has been detected, on the other hand, the control unit 70 moves on to step S43, and calculates the cycles T2 in which feature images are detected. A cycle T2 is an integral multiple of a cycle T1. The control unit 70 then determines whether the vibration cycles Tv2 of the photosensitive member 3K correspond to the cycles T2 in which feature images are detected. More specifically, the control unit 70 determines whether the value obtained by dividing a cycle T2 by a cycle Tv2 is an integer or a value close to an integer. A value close to an integer is a value with an error of 1%, for example. In this case, 3.01 and 2.99 are determined to be values close to an integer. Each vibration cycle Tv2 of the photosensitive member 3K is represented by the value obtained by dividing the outer circumference of the photosensitive member 3K by the surface velocity (printing speed) of the photosensitive member 3K during image pattern formation. That is, each vibration cycle Tv2 of the photosensitive member 3K has a value that depends on the outer circumference of the photosensitive member 3K.

If it is determined that the cycles Tv2 correspond to the cycles T2 (YES in step S44), the control unit 70 determines that the state of the photosensitive member 3K has deteriorated. If it is determined that the cycles Tv2 do not correspond to the cycles T2 (NO in step S44), on the other hand, the control unit 70 determines that the state of the photosensitive member 3K has not deteriorated.

As described above, the image forming apparatus 100 according to the first embodiment can determine the state of a rotary member of the image forming apparatus 100 by comparing the vibration cycles of the rotary member with the cycles in which interference occurs.

The image forming apparatus 100 according to the first embodiment also determines the state of a rotary member in accordance with the cycles in which a feature image having a higher density due to interference appears. Because of this, the image forming apparatus 100 according to the first embodiment can determine the state of a rotary member with a higher sensitivity than in a case where solid images or halftone images having a uniform density in the sub scanning direction are used as the image patterns. Thus, the image forming apparatus 100 can accurately determine the state of a rotary member, using an inexpensive sensor with a lower sensitivity as the density sensor 9.

Furthermore, the density sensor 9 is normally installed in an image forming apparatus, to control image density. Accordingly, any additional sensor for detecting the state of a rotary member does not need to be installed in the image forming apparatus 100 according to this embodiment. Without such an additional sensor, the image forming apparatus 100 can determine the state of the rotary member.

In the example described above, the control unit 70 calculates the cycle T2 as a time in which a feature image is detected. In other situations, however, the cycle T2 may be calculated as the number of sets of unit data forming the image patterns (for example, the cycle T2 is four in a case where one in four sets of unit data exceeds the threshold amplitude Vth1). In this case, the control unit 70 stores beforehand the number (four, for example) of sets of unit data as the cycle in which a feature image is detected, the cycle being determined from the outer circumference of the rotary member (such as the photosensitive member 3K) being tested and the cycle T1. In accordance with whether the stored number matches the number of sets of unit data actually calculated as a cycle, the control unit 70 determines whether the rotary member has deteriorated.

In addition, in the example described above, the image forming apparatus 100 has the density sensor 9 provided to detect the density of an image pattern formed on the intermediate transfer belt 1. However, the present technology is not limited to that. In another aspect of the present technology, an image forming apparatus may be designed to detect the density of an image pattern formed on the photosensitive member of each image forming unit. In yet another aspect of the present technology, an image forming apparatus may be designed to read an image pattern formed on a recording medium such as a paper sheet, and detect the density of the image pattern.

C. Second Embodiment: Identifying a Vibrating Rotary Member

The image forming apparatus 100 according to the first embodiment determines whether the cycles T2 in which a feature image is detected correspond to the vibration cycles of a certain rotary member. When the cycles T2 correspond to the vibration cycles, the image forming apparatus 100 determines that the certain rotary member is vibrating in such a manner as to cause interference, or that the certain rotary member has deteriorated. An image forming apparatus according to a second embodiment stores the outer circumferences of the respective rotary members in the image forming apparatus, and identifies the rotary member in synchronization with the cycles T2, or the rotary member that has deteriorated. Further, the image forming apparatus according to the second embodiment determines the state of the identified rotary member, in accordance with the amplitude of the density of feature images (this amplitude will be hereinafter also referred to as the "feature image amplitude") based on a reference density Va. The basic configuration of the image forming apparatus according to the second embodiment is substantially the same as the basic configuration of the image forming apparatus 100 according to the first embodiment, and therefore, only the different aspects from the first embodiment will be described below.

(c1. Determination on the State of a Rotary Member in Accordance with a Feature Image Amplitude)

Figure 9:
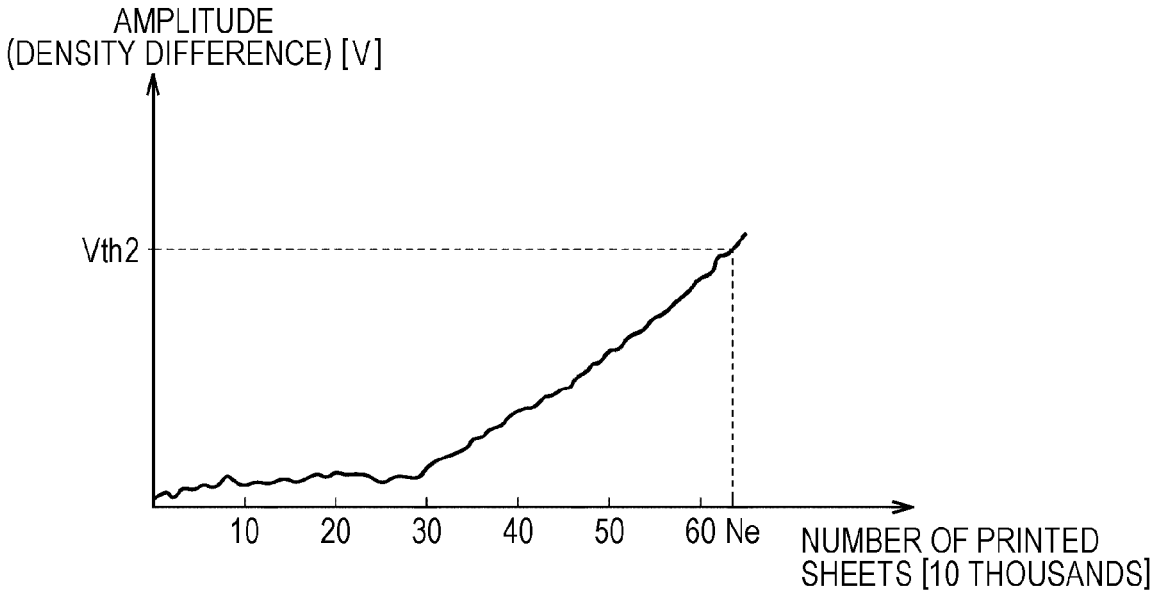
FIG. 9 is a diagram for explaining the relationship between the feature image amplitude and the number of printed paper sheets according to a second embodiment.

FIG. 9 is a diagram for explaining the relationship between the feature image amplitude (the density difference between the reference density and the density of feature images) and the number of printed paper sheets according to the second embodiment. As shown in FIG. 9, no great changes are seen in the feature image amplitude until the number of paper sheets printed by the image forming apparatus 100 reaches approximately 300000. This is because vibration of the rotary member of the image forming apparatus 100 is sufficiently small, and the interference between vibration of the rotary member and an image pattern cannot be detected as a feature image, as described above with reference to FIG. 6.

After a rotary member is used a certain number of times, the bearing and the gear become worn, and greatly vibrate. Therefore, after the number of paper sheets printed by the image forming apparatus 100 exceeds 300000, the amplitude of vibration of each rotary member and the feature image amplitude become greater as the number of printed paper sheets increases. Taking advantage of this feature, the image forming apparatus according to the second embodiment determines that the corresponding rotary member has deteriorated to a greater degree as the feature image amplitude becomes greater.

(c2. Identifying a Deteriorated Rotary Member and Determining the Life of the Rotary Member)

Figure 10:
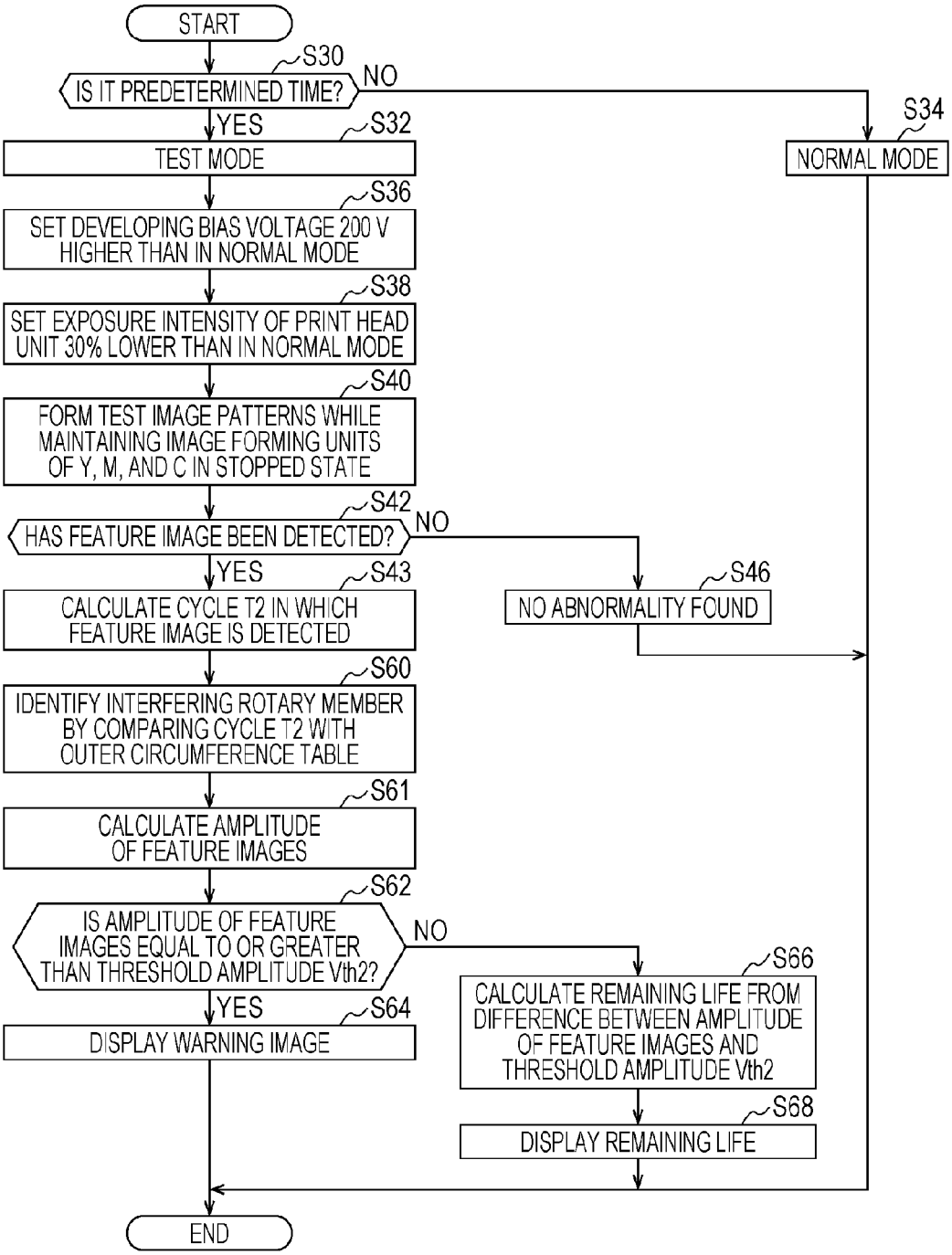
FIG. 10 is a flowchart for explaining the control to be performed to determine the state of a rotary member of an image forming apparatus according to the second embodiment.

Next, the control to be performed to identify a deteriorated rotary member from the cycles T2 in which a feature image is detected is described. FIG. 10 is a flowchart for explaining the control to be performed to determine the state of a rotary member in the image forming apparatus 100 according to the second embodiment. The same components as those shown in FIG. 8 are denoted by the same reference numerals as those used in FIG. 8, and therefore, explanation of those components is not repeated herein.

As shown in FIG. 10, in step S60, the control unit 70 identifies the interfering rotary member by comparing the cycles T2 in which a feature image is detected with an outer circumference table Ta1. FIG. 11 is a diagram for explaining the outer circumference table Ta1 according to the second embodiment. As shown in FIG. 11, the outer circumference table Ta1 stores the rotary members in the image forming apparatus 100, the outer circumferences of the rotary members, and the vibration cycles of the rotary members. The outer circumferences and the vibration cycles are associated with the corresponding rotary members. The control unit 70 performs the same operation as that in step S44 in FIG. 8, or determines whether the cycles T2 correspond to the vibration cycles of each of the rotary members stored in the outer circumference table Ta1. The control unit 70 determines that the rotary member having vibration cycles corresponding to the cycles T2 is an interfering rotary member among the rotary members stored in the outer circumference table Ta1.

In step S61, the control unit 70 calculates the feature image amplitude. More specifically, the control unit 70 calculates the feature image amplitude by subtracting the reference density Va from the density of the feature images.

In step S62, the control unit 70 determines whether the calculated feature image amplitude is greater than a threshold amplitude Vth2 to be used in determining that the rotary member is broken. In another aspect of the present technology, the threshold amplitudes Vth2 to be used in determining whether the respective rotary members are broken may be further associated with the respective rotary members in the outer circumference table Ta1. With this configuration, the control unit 70 can more accurately determine whether each rotary member is broken.

If it is determined that the feature image amplitude is equal to or greater than the threshold amplitude Vth2 (YES in step S62), the control unit 70 determines that the rotary member identified in step S60 is already broken, and causes the display unit 80 to display a warning image indicating a warning to that effect (step S64).

If it is determined that the feature image amplitude is smaller than the threshold amplitude Vth2 (NO in step S62), on the other hand, the control unit 70 calculates the remaining life of the rotary member identified in step S60 in accordance with the difference between the feature image amplitude and the threshold amplitude Vth2, and causes the display unit 80 to display the calculated remaining life (step S68). The remaining life of the rotary member may be represented by the number of paper sheets to be printed before the feature image amplitude reaches the threshold amplitude Vth2 with which the rotary member is determined to be broken, for example. More specifically, the control unit 70 calculates the number Ne of printed paper sheets at the time when the feature image amplitude reaches the threshold amplitude Vth2, using two or more sets of history information in which the feature image amplitude is associated with the numbers of printed paper sheets as shown in FIG. 9. The difference from the current number of printed paper sheets is displayed as the remaining life of the rotary member. When predicting the number Ne of printed paper sheets in this case, the control unit 70 may use approximate expressions stored in the storage device 90, and the approximate expression having the highest determination coefficient.

As described above, the image forming apparatus according to the second embodiment can determine which one of the rotary members in the image forming apparatus has deteriorated, by identifying the rotary member having the vibration cycles corresponding to the cycles in which interference occurs.

Furthermore, the image forming apparatus according to the second embodiment can specifically determine to what degree the identified rotary member has deteriorated, and accurately determine the remaining life of the rotary member, in accordance with the feature image amplitude. Accordingly, the user of the image forming apparatus according to the second embodiment can replace the rotary member with a new one before the rotary member becomes broken. To replace a component before the component is broken, a conventional image forming apparatus is equipped with a large number of sensors for monitoring the respective components, or has a maintenance personnel assess the states of the components. In the former case, however, the large number of sensors add to the costs and the size of the image forming apparatus. In the latter case, a long time and large costs are required for identifying a broken component, and the accuracy in the remaining life assessment performed by a person is low. To counter these problems, the image forming apparatus according to the second embodiment uses the density sensor 9 designed for image adjustment as it is, and monitors the states of rotary members. Thus, decreases in costs and size can be achieved, and short-time measurement and high-precision deterioration detection can be performed.

Figure 12:
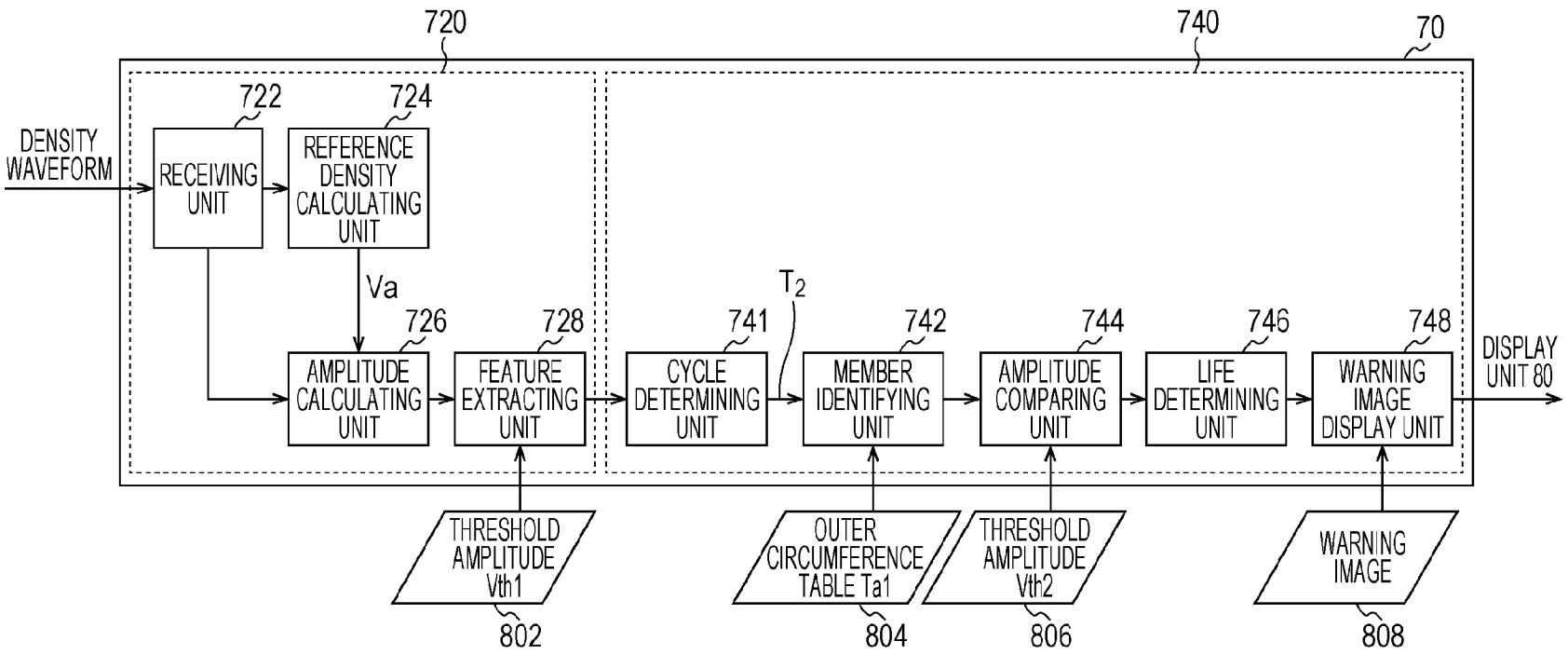
FIG. 12 is a functional block diagram for explaining the functional configuration of a control unit according to the second embodiment.

Next, the functional configuration of the control unit 70 that performs the above described series of control processes is described. FIG. 12 is a functional block diagram for explaining the functional configuration of the control unit 70 according to the second embodiment. As shown in FIG. 12, the control unit 70 includes a cyclic image detector 720 and a state determining unit 740. The cyclic image detector 720 includes a receiving unit 722, a reference density calculating unit 724, an amplitude calculating unit 726, and a feature extracting unit 728. The state determining unit 740 includes a cycle determining unit 741, a member identifying unit 742, an amplitude comparing unit 744, a life determining unit 746, and a warning image display unit 748.

The receiving unit 722 receives an input of the density waveform of image patterns from the density sensor 9, and outputs the data to the reference density calculating unit 724 and the amplitude calculating unit 726. The reference density calculating unit 724 determines the reference density Va to be the lowest density in the density waveform of the image patterns in a predetermined period, and outputs the determined reference density Va to the amplitude calculating unit 726.

The amplitude calculating unit 726 calculates an amplitude by subtracting the reference density Va from the density of the image pattern, and outputs the calculated amplitude to the feature extracting unit 728. From the input amplitude waveform, the feature extracting unit 728 extracts a greater amplitude (corresponding to a feature image) than the threshold amplitude Vth1 (802), and outputs the extracted information to the cycle determining unit 741.

The cycle determining unit 741 calculates the cycle T2 in which a greater amplitude than the threshold amplitude Vth1 (802) is detected, and outputs the cycle T2 to the member identifying unit 742. The member identifying unit 742 compares the cycle T2 with the vibration cycles of the respective rotary members stored in the outer circumference table Ta1 (804), and identifies a vibrating (deteriorated) rotary member. The amplitude comparing unit 744 determines whether the feature image amplitude corresponding to the cycle T2 is equal to or greater than the threshold amplitude Vth2 (806), and outputs the comparison result to the life determining unit 746. If it is determined that the feature image amplitude is smaller than the threshold amplitude Vth2 (806), the amplitude comparing unit 744 outputs the difference between these amplitudes to the life determining unit 746.

In accordance with the comparison result from the amplitude comparing unit 744, the life determining unit 746 determines the remaining life of the rotary member identified by the member identifying unit 742, and outputs the result to the warning image display unit 748. The warning image display unit 748 outputs a warning image (808) according to the result of the determination made by the life determining unit 746, to the display unit 80.

It should be noted that the threshold amplitude Vth1 (802), the outer circumference table Ta1 (804), the threshold amplitude Vth2 (806), the warning image (808) are all stored in the storage device 90.

D. Third Embodiment: Control to be Performed in a Case where Rotary Members are Vibrating (1)

In the embodiments described above, control to be performed in a case where a single rotary member is vibrating has been described. However, where an image forming apparatus has been used over a long time, two or more rotary members might greatly vibrate. To counter this, an image forming apparatus according to a third embodiment identifies vibrating rotary members, and determines the remaining lives of the identified rotary members. In the description below, this control operation will be explained. The basic configuration of the image forming apparatus according to the third embodiment is substantially the same as the basic configuration of the image forming apparatus 100 according to the first embodiment, and therefore, only the different aspects from the first embodiment will be described below.

Figure 13:
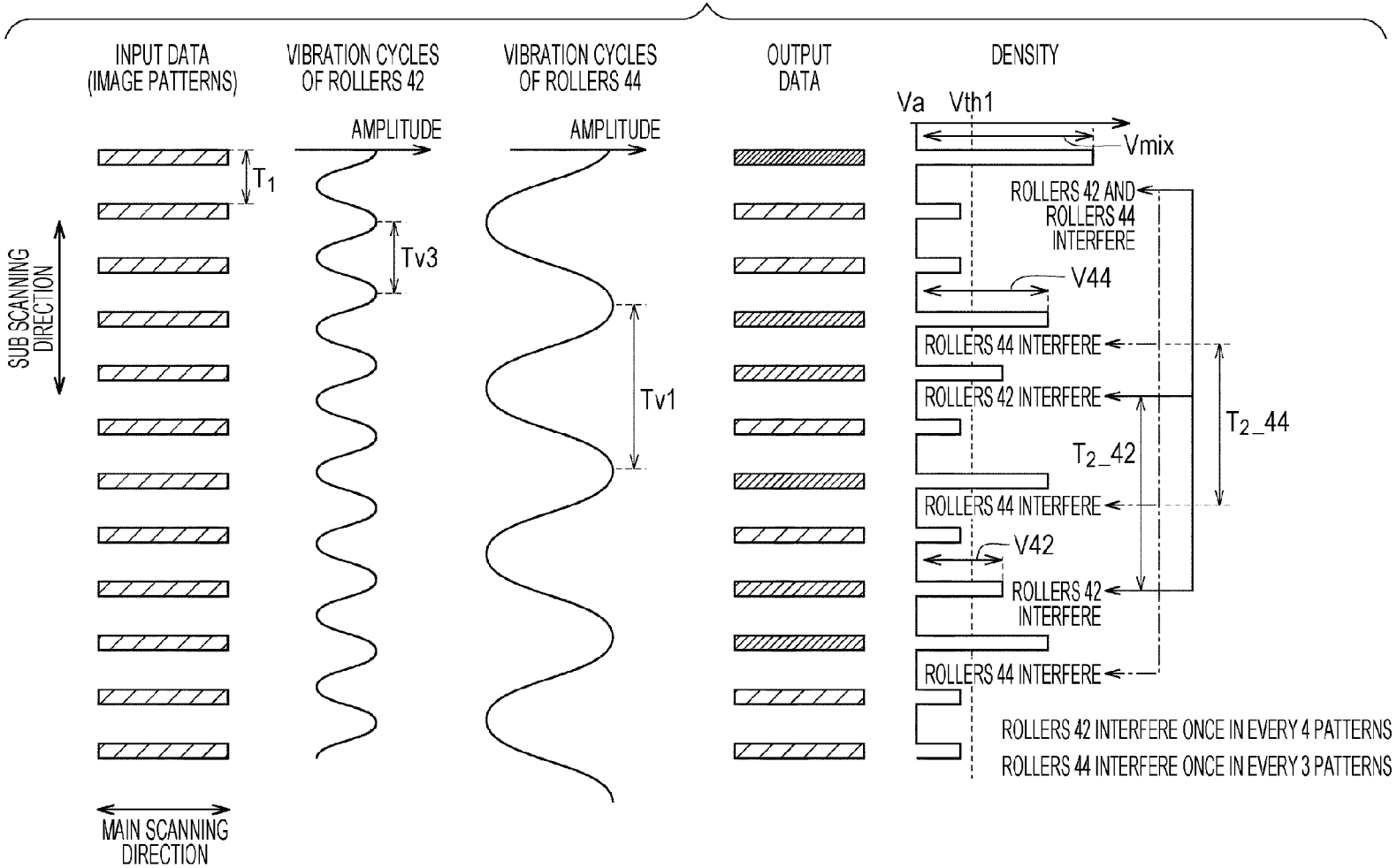
FIG. 13 is a diagram for explaining the relationship between vibration of rotary members and feature images according to a third embodiment.

FIG. 13 is a diagram for explaining the relationship between vibration of rotary members and feature images according to the third embodiment. FIG. 13 shows an example case where the rollers 42 and 44, which are two rotary members with different outer circumferences, are greatly vibrating as will be described below. The rollers 42 are cyclically vibrating in vibration cycles Tv3, and the rollers 44 are cyclically vibrating in vibration cycles Tv1. Therefore, interference occurs in cycles of the least common multiple among the vibration cycles Tv1, the vibration cycles Tv3, and the cycles T1 in which an image area is formed. Referring now to FIG. 14, identifying the vibrating rotary members in a case where two or more rotary members are vibrating is described.

FIG. 14 is a flowchart for explaining the control to be performed to determine the states of rotary members in the image forming apparatus 100 according to the third embodiment. It should be noted that explanation of the components denoted by the same reference numerals as those used in FIG. 10 is not repeated herein. As shown in FIG. 14, in step S70, the control unit 70 counts the number of types of feature images. More specifically, the control unit 70 determines that feature images having substantially the same amplitudes (amplitudes with an error of 1% or smaller) are of the same type. In the example shown in FIG. 13, the control unit 70 determines that there are three types of feature images: one with an amplitude V42, one with an amplitude V44, and one with an amplitude Vmix.

In step S72, the control unit 70 identifies the undetermined members corresponding to the respective feature images. More specifically, the control unit 70 first determines that two rotary members are vibrating, because there are three types of feature images. At this point of time, the control unit 70 is unable to identify these two rotary members, and therefore, these two rotary members are defined as a member A and a member B that are undetermined members, for the sake of convenience. Since the amplitude Vmix has the greatest amplitude, the control unit 70 determines that each feature image corresponding to the amplitude Vmix is a feature image in which both vibration of the member A and vibration of the member B interfere with an image pattern. The control unit 70 then determines that each feature image corresponding to the amplitude V42 and each feature image corresponding to the amplitude V44 are a feature image in which vibration of the member A interferes with an image pattern, and a feature image in which vibration of the member B interferes with an image pattern, respectively.

In step S74, the control unit 70 detects the cycles in which the feature images generated by interference between vibration of the respective undetermined members and image patterns (the cycles will be hereinafter also referred to as the "cycles of the undetermined members"). In the example shown in FIG. 13, the control unit 70 calculates cycles T2A of the member A from the cycles in which the amplitude V42 or the amplitude Vmix is detected, and calculates cycles T2B of the member B from the cycles in which the amplitude V44 or the amplitude Vmix is detected.

In step S76, the control unit 70 compares the cycles of the respective undetermined members with the vibration cycles of the rotary members stored in the outer circumference table Ta1, and identifies the rotary members corresponding to the cycles of the respective undetermined members. In the example shown in FIG. 13, the control unit 70 identifies the rollers 42 as the rotary member corresponding to the cycles T2A, and the rollers 44 as the rotary member corresponding to the cycles T2B.

In step S78, the control unit 70 determines whether the feature image amplitudes corresponding to the identified rotary members are equal to or greater than the threshold amplitude Vth2. In the example shown in FIG. 13, the control unit 70 determines whether the feature image amplitude V42 corresponding only to the rollers 42, and the feature image amplitude V44 corresponding only to the rollers 44 are equal to or greater than the threshold amplitude Vth2.

In step S80, the control unit 70 determines that each rotary member corresponding to the feature images having an amplitude equal to or greater than the threshold amplitude Vth2 is already broken, and causes the display unit 80 to display a warning image indicating a warning to that effect.

In step S82, the control unit 70 calculates the remaining life of each rotary member corresponding to the feature images determined to have a smaller amplitude than the threshold amplitude Vth2, in accordance with a difference from the threshold amplitude Vth2. In step S84, the control unit 70 causes the display unit 80 to display the calculated remaining life.

As described above, the image forming apparatus according to the third embodiment can calculate, for each rotary member (each undetermined member), the cycles in which a feature image corresponding to interference between vibration of the rotary member and an image pattern, even in a case where two or more rotary members are vibrating. Thus, it is possible to identify which rotary members are vibrating. Further, the image forming apparatus can determine the remaining life of each identified rotary member.

It should be noted that the control unit 70 can calculate the cycles of each undetermined member by performing the process shown in the flowchart in FIG. 14, even in a case where three or more rotary members are vibrating.

Alternatively, in another aspect of the present technology, the image forming apparatus according to the third embodiment may be designed to identify the number of vibrating rotary members, and determine the cycles of undetermined members, starting from the shortest cycles among the cycles in which feature images having substantially the same amplitudes are detected. With this configuration, the control unit 70 can skip the control in step S72, and accordingly, can calculate the cycles of each undetermined member at a higher speed.

E. Fourth Embodiment: Control to be Performed in a Case where Rotary Members are Vibrating (2)

The image forming apparatus according to the third embodiment is designed to determine the states of rotary members, using image patterns having only one type of cycle T1 in which an image area is formed. In the above configuration, however, the processing becomes more complicated as the number of rotary members vibrating greatly increases to three and then to four. Furthermore, a longer time is required for identifying the members that are vibrating. In a case where three rotary members are greatly vibrating, for example, the number of types of feature portions in step S70 is seven ($={}_3C_1+{}_3C_2+{}_3C_3$). To counter this, an image forming apparatus according to a fourth embodiment prepares image patterns of cycles T1 that conspicuously interfere with vibration of certain rotary members, for each of the rotary members that have a possibility of being broken. The image forming apparatus then determines the states of the rotary members independently of one another.

Figure 15:
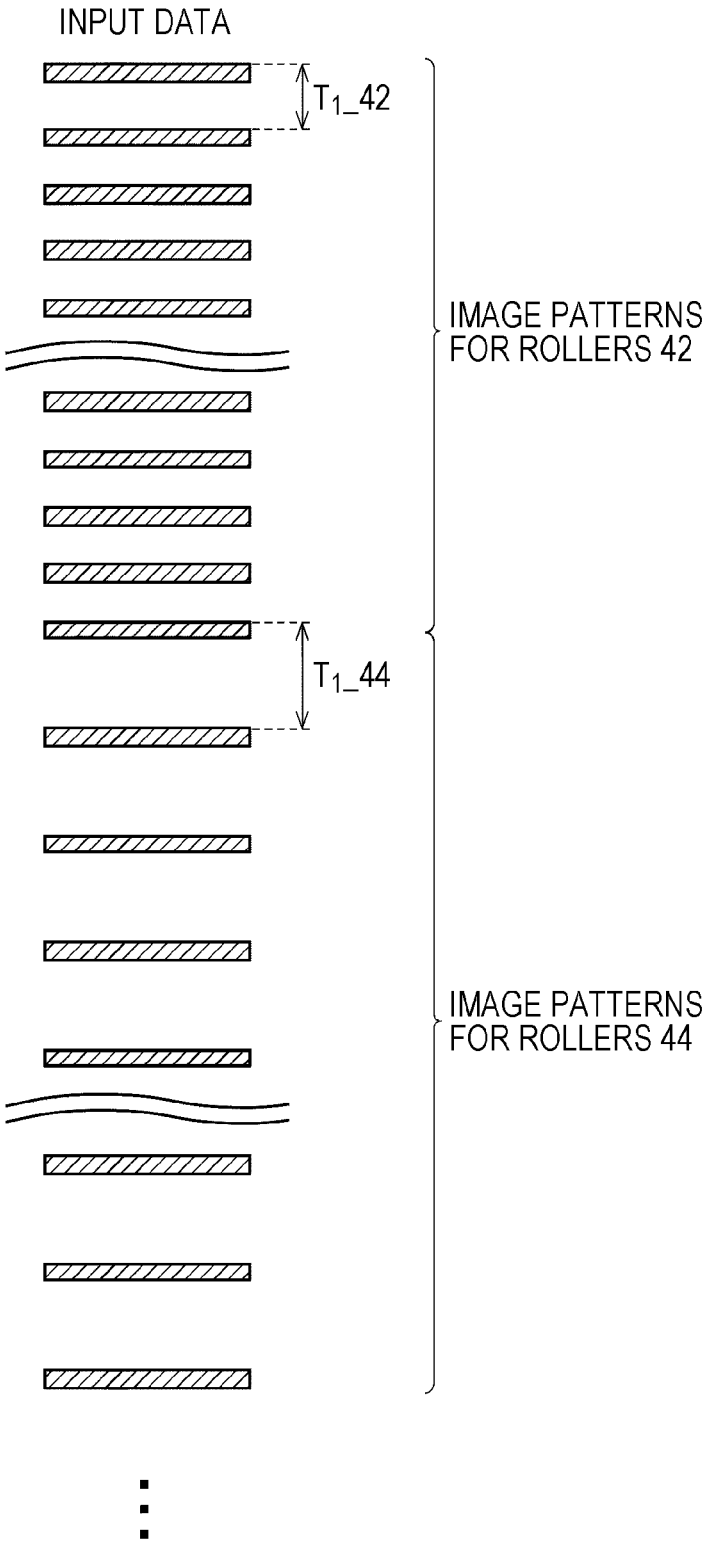
FIG. 15 is a diagram for explaining image patterns according to a fourth embodiment.

FIG. 15 is a diagram for explaining image patterns according to the fourth embodiment. The control unit 70 is to determine the states of the rollers 42 and 44, for example. The outer circumferences of the rollers 42 and 44 are 62 mm and 38 mm, respectively.

For example, to determine the state of the rollers 42, the control unit 70 forms image patterns that are 124 mm in the sub scanning direction, and sets cycles T1_42 so that image areas are to be formed at intervals of 31 mm in the sub scanning direction. Under this condition, interference between vibration of the rollers 42 and the image patterns occur at intervals of 62 mm. Meanwhile, intervals between vibration of the rollers 44 and the image patterns occurs at intervals of 1178 mm. Therefore, the control unit 70 can detect the cycles in which interference occurs between vibration of the rollers 42 and the image patterns, but cannot detect the cycles in which interference occurs between vibration of the rollers 44 and the image patterns. Under this condition, the control unit 70 determines whether the cycles T2 in which a feature image is detected correspond to the vibration cycles of the rollers 42 (or the value obtained by dividing 62 mm by the surface velocity of the intermediate transfer belt 1). If the cycles T2 correspond to the vibration cycles of the rollers 42, the control unit 70 determines that the rollers 42 have deteriorated.

To determine the state of the rollers 44, the control unit 70 then forms image patterns that are 76 mm in the sub scanning direction, and sets cycles T1_44 so that image areas are to be formed at intervals of 19 mm in the sub scanning direction. Under this condition, interference between vibration of the rollers 44 and the image patterns occur at intervals of 38 mm. Meanwhile, intervals between vibration of the rollers 42 and the image patterns occurs at intervals of 1178 mm. Therefore, under this condition, the control unit 70 can detect the cycles in which interference occurs between vibration of the rollers 44 and the image patterns, but cannot detect the cycles in which interference occurs between vibration of the rollers 42 and the image patterns. Under this condition, the control unit 70 determines whether the cycles T2 in which a feature image is detected correspond to the vibration cycles of the rollers 44 (or the value obtained by dividing 38 mm by the surface velocity of the intermediate transfer belt 1). If the cycles T2 correspond to the vibration cycles of the rollers 44, the control unit 70 determines that the rollers 44 have deteriorated.

To reduce toner consumption and shorten the moving distances of the photosensitive members and the like, the length of the image patterns in the sub scanning direction is preferably small. In view of this, to grasp the states of the rollers 42 and 44, the image forming apparatus according to the fourth embodiment forms image patterns that are 124 mm and have the cycles T1_42 in which an image area is formed, and forms image patterns that are 76 mm and have the cycles T1_44 in which an image area is formed. That is, a total of 200 mm of image patterns are formed. On the other hand, the image forming apparatus according to the third embodiment needs to form image patterns that are at least 1178 mm, to grasp the states of the rollers 42 and 44.

As described above, for each of the rotary members that have a possibility of being broken, the image forming apparatus according to the fourth embodiment prepares image patterns in cycles that conspicuously interfere with vibration of the respective rotary members. Thus, the image forming apparatus can determine the states of rotary members, using image patterns that are short in the sub scanning direction. Furthermore, the image forming apparatus according to the fourth embodiment does not need to perform a complicated process like steps S70 through S74 shown in FIG. 14. Accordingly, the image forming apparatus according to the fourth embodiment can determine the states of two or more rotary members in a shorter period of time than the image forming apparatus according to the third embodiment does.

F. Fifth Embodiment: Speeds at which Image Patterns are Formed

Figure 16:
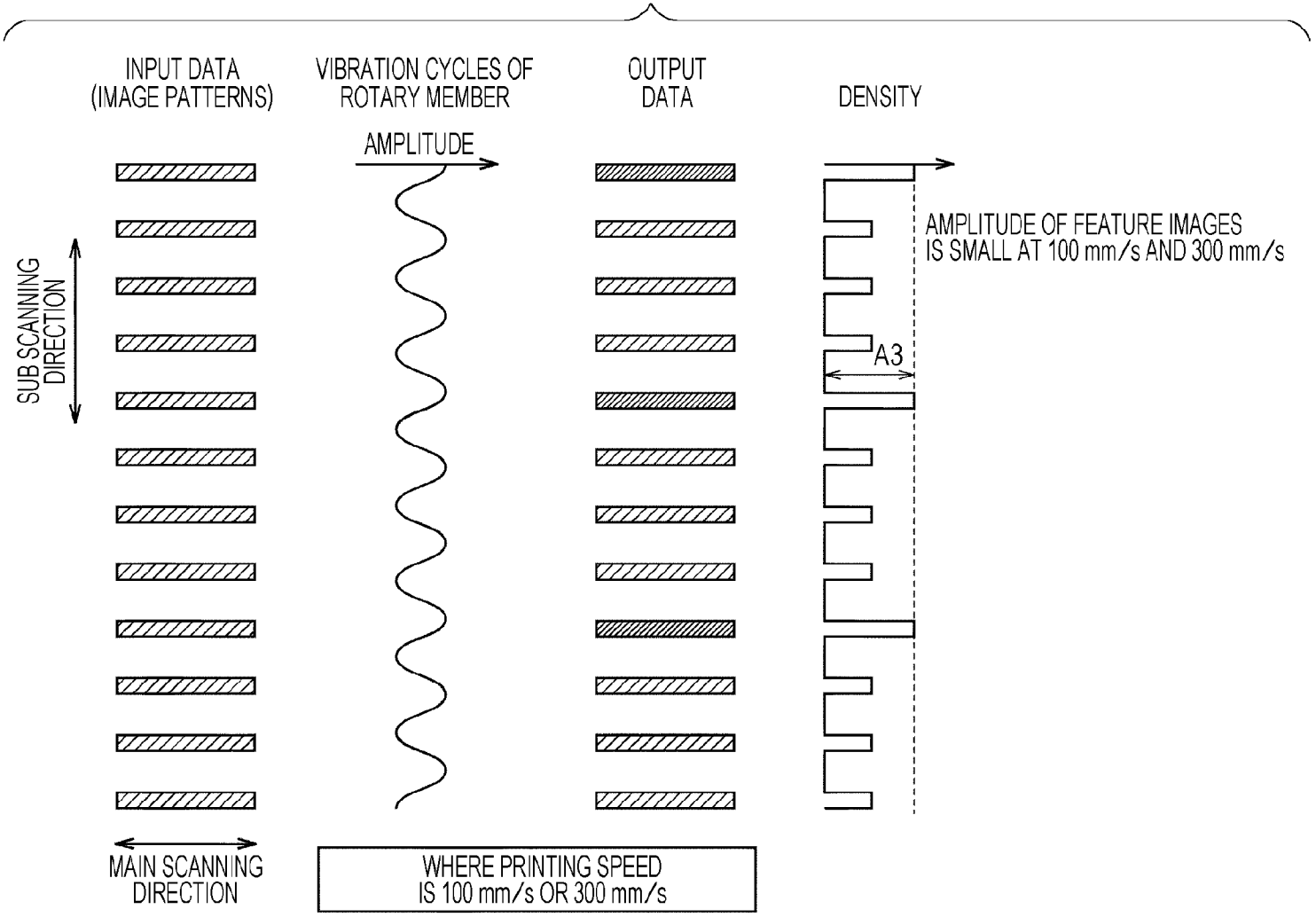
FIG. 16 is a diagram (part 1) for explaining the relationship between the feature image amplitude and the printing speed according to a fifth embodiment.
Figure 17:
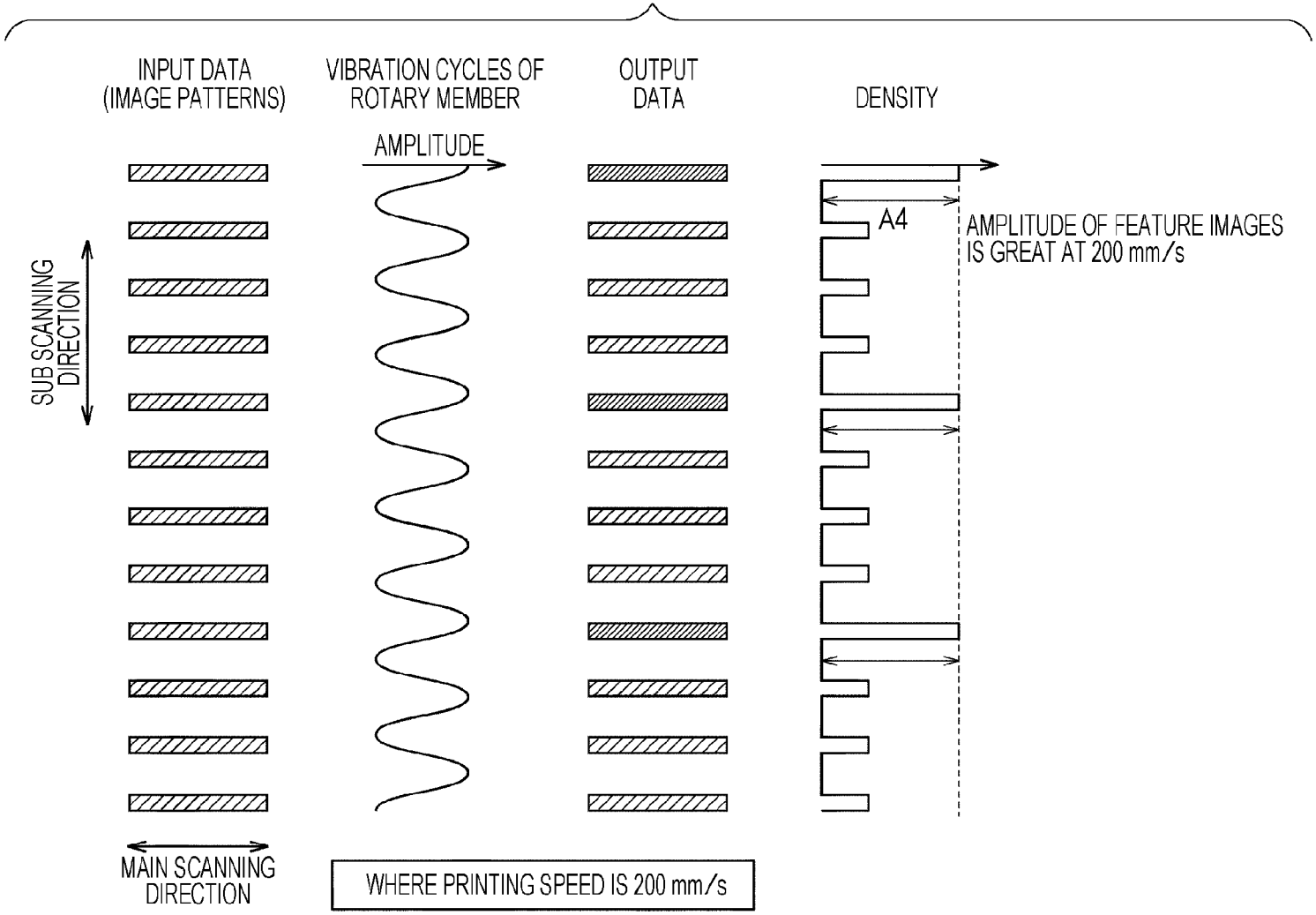
FIG. 17 is a diagram (part 2) for explaining the relationship between the feature image amplitude and the printing speed according to the fifth embodiment.

FIG. 16 is a diagram (part 1) for explaining the relationship between the feature image amplitude and the printing speed according to a fifth embodiment. As shown in FIG. 16, when image patterns are formed at photosensitive member surface velocities (printing speeds) of 100 mm/sec and 300 mm/sec, the feature image amplitude is represented by A3.

Where image patterns are formed at a printing speed of 200 mm/sec, the feature image amplitude is represented by A4, as shown in FIG. 17. In FIGS. 16 and 17, the feature image amplitude A4 is greater than the feature image amplitude A3, though the only different condition is the printing speed at which the image patterns are formed.

As shown in FIGS. 16 and 17, the feature image amplitude varies with the printing speed. As described above, an image forming apparatus according to an embodiment determines the remaining life of a rotary member in accordance with the feature image amplitude. Therefore, when the feature image amplitude changes, the image forming apparatus might inaccurately calculate the remaining life of a rotary member. To reduce the influence of changes in the feature image amplitude due to the printing speed, an image forming apparatus 100 according to the fifth embodiment forms image patterns at two or more printing speeds, and then determines the state of a rotary member. The basic configuration of the image forming apparatus according to the fifth embodiment is substantially the same as the basic configuration of the image forming apparatus 100 according to the first embodiment, and therefore, only the different aspects from the first embodiment will be described below.

The image forming apparatus 100 according to the fifth embodiment forms image patterns at the three printing speeds of 100 mm/sec, 200 mm/sec, and 300 mm/sec, for example. The control unit 70 calculates the amplitudes of feature images at the respective printing speeds, and stores the calculated amplitudes into the RAM 74.

The control unit 70 then determines the greatest feature image amplitude among the calculated feature image amplitudes. In accordance with the greatest feature image amplitude, the control unit 70 identifies the rotary member, and determines the remaining life of the rotary member.

As described above, the image forming apparatus 100 according to the fifth embodiment can reduce the influence of changes in the feature image amplitude due to the printing speed, and accurately determine the state of the rotary member.

In another aspect of the present technology, the image forming apparatus 100 according to the fifth embodiment may be designed to form image patterns at a predetermined printing speed, identify a vibrating rotary member, further form image patterns at a printing speed at which the identified rotary member easily vibrates, and determine the state of the identified rotary member in accordance with the feature image amplitude under this condition. The image forming apparatus having this configuration can form image patterns at a printing speed at which the identified rotary member easily vibrates, and more accurately determine the state of the rotary member. In such a case, the printing speeds at which the respective rotary members easily vibrate are determined by the outer circumferences and the masses of the rotary members, the installation positions of the rotary members in the image forming apparatus, and the like. The printing speeds are preferably measured in advance, and are stored in the storage device 90.

G. First Modification: Image Patterns

In the embodiments described above, the unit data forming an image pattern is a uniform image formed over a period in a cycle T1. However, the present technology is not limited to that. In another aspect of the present technology, the unit data forming an image pattern may be a gradation image in which the toner density continuously changes during the cycle T1. In yet another aspect, the unit data forming an image pattern may be an image in which the density continuously changes over a period in the cycle T1. Under such conditions, interference also occurs between vibration of a rotary member and image patterns. Thus, the image forming apparatus can determine the state of a rotary member.

It is also possible to employ any appropriate combination of the above described first through fifth embodiments and the first modification.

Further, it is possible to provide the control program 92 for causing a computer to perform the control described above with reference to the flowcharts. Such a program can be provided as a program product that is recorded in a non-transitory, computer-readable recording medium accompanying a computer, such as a flexible disk, a compact disk-read only memory (CD-ROM), a read only memory (ROM), a random access memory (RAM), or a memory card. Alternatively, the program may be recorded in a recording medium such as an internal hard disk in a computer. The program may also be provided through downloading via a network.

A program may be designed to invoke necessary modules in a predetermined order at a predetermined time among program modules provided as part of the operating system (OS) of a computer, and cause the modules to perform processes. A program according to an embodiment of the present invention may be incorporated into another program, and be provided as part of another program.

A provided program product is installed into a program storage unit such as a hard disk, and is then executed. A program product includes a program and a recording medium in which the program is recorded.

Although the present invention has been described and illustrated in detail, it is clearly understood that the same is by way of illustrated and example only and is not to be taken byway of limitation, the scope of the present invention being interpreted by terms of the appended claims. It should be understood that equivalents of the claimed inventions and all modifications thereof are incorporated herein.

What is claimed is:

1. An image forming apparatus comprising:

an image forming unit configured to form an image pattern on a medium, a predetermined image repeatedly appearing in a first cycle in a sub scanning direction in the image pattern;

a density detector configured to optically detect a density of the image pattern in the sub scanning direction;

a cyclic image detector configured to detect a feature image having a second cycle corresponding to the first cycle, in accordance with a result of the detection performed by the density detector; and a state determining unit configured to determine whether a cycle depending on an outer circumference of a rotary member included in the image forming apparatus corresponds to the second cycle when the feature image is detected by the cyclic image detector, and determine that a state of the rotary member has deteriorated when the cycle depending on the outer circumference is determined to correspond to the second cycle.

2. The image forming apparatus according to claim 1, wherein the cyclic image detector calculates a reference density from the result of the detection performed by the density detector, and the second cycle includes a period during which an amplitude of the density of the image pattern based on the reference density is greater than a first amplitude.

3. The image forming apparatus according to claim 2, wherein the second cycle includes a period during which substantially the same amplitude is detected from the amplitude of the density of the image pattern greater than the first amplitude.

4. The image forming apparatus according to claim 1, wherein the predetermined image includes a uniform image formed over a period in the first cycle.

5. The image forming apparatus according to claim 1, wherein the predetermined image includes an image having a density continuously changing at least over a period in the first cycle.

6. The image forming apparatus according to claim 4, wherein the reference density includes the lowest density in the density of the image pattern over a predetermined period, the predetermined period being longer than the first cycle.

7. The image forming apparatus according to claim 4, wherein the reference density includes a mean density of a non-image area excluding an area in which the uniform image is formed in a predetermined period, the predetermined period being longer than the first cycle.

8. The image forming apparatus according to claim 1, wherein when determining that the cycle depending on the outer circumference of the rotary member corresponds to the second cycle, the state determining unit determines that the rotary member has deteriorated to a greater extent as an amplitude of a density of the feature image is greater.

9. The image forming apparatus according to claim 8, wherein, when the amplitude of the density of the feature image exceeds a second amplitude, the state determining unit determines that the life of the rotary member has come to an end.

10. The image forming apparatus according to claim 8, wherein the image forming unit forms the image pattern on a medium at different printing speeds, and the state determining unit determines the state of the rotary member in accordance with an amplitude of a feature image having the greatest amplitude among feature images detected at the different printing speeds.

11. The image forming apparatus according to claim 9, further comprising a display unit configured to present information to a user, wherein when determining that the life of the rotary member has come to an end, the state determining unit causes the display unit to display a warning.

12. The image forming apparatus according to claim 1, further comprising a storage unit storing information related to outer circumferences of a plurality of rotary members included in the image forming apparatus, wherein when the cyclic image detector detects the feature image, the state determining unit compares the second cycle with cycles corresponding to the respective outer circumferences of the rotary members, and determines that a state of a rotary member corresponding to the second cycle among the rotary members has deteriorated.

13. The image forming apparatus according to claim 1, further comprising a processor configured to be capable of switching between a normal mode for printing out input image data and a test mode for determining the state of the rotary member, wherein in the test mode, the processor forms the image pattern on a medium under a different printing condition from the normal mode.

14. The image forming apparatus according to claim 13, wherein the processor switches to the test mode at a predetermined time.

15. The image forming apparatus according to claim 13, further comprising:

an image carrier configured to carry a latent image; and an exposure device configured to expose the image pattern on the image carrier, wherein the image forming unit includes a developer carrier, and develops the image pattern on the image carrier by applying a developing bias voltage to the developer carrier and supplying a developer to the latent image corresponding to the image pattern, and, in the test mode, the processor performs at least one of a control operation to reduce a light intensity of the exposure device to a smaller value than in the normal mode, and a control operation to set the developing bias voltage at a greater value than in the normal mode.

16. The image forming apparatus according to claim 1, wherein a spot diameter of a light flux emitted from the density detector is smaller than a value obtained by dividing a cycle equivalent to the least common multiple between the first cycle and the cycle depending on the outer circumference of the rotary member by a surface velocity of the rotary member.

17. The image forming apparatus according to claim 1, wherein the image forming unit forms the image pattern on a medium by an electrophotographic method.

18. A non-transitory recording medium storing a computer readable control program to be executed by a computer of an image forming apparatus to determine a state of a rotary member included in the image forming apparatus, the control program causing the computer to execute:

a step of causing an image forming unit to form an image pattern on a medium, a predetermined image repeatedly appearing in a first cycle in a sub scanning direction in the image pattern;

a step of causing an optical sensor to optically detect a density of the image pattern in the sub scanning direction;

a step of determining whether a feature image having a second cycle corresponding to the first cycle is detected, in accordance with a result of the detection performed by the optical sensor;

a step of determining whether a cycle depending on an outer circumference of the rotary member corresponds to the second cycle, when the feature image is detected in the second cycle; and a step of determining that the state of the rotary member has deteriorated, when the cycle depending on the outer circumference of the rotary member is determined to correspond to the second cycle.

19. An image forming method comprising:

an image forming step of forming an image pattern on a medium, a predetermined image repeatedly appearing in a first cycle in a sub scanning direction in the image pattern;

a density detecting step of optically detecting a density of the image pattern in the sub scanning direction;

a cyclic image detecting step of detecting a feature image having a second cycle corresponding to the first cycle, in accordance with a result of the detection performed in the density detecting step; and a state determining step of determining whether a cycle depending on an outer circumference of a rotary member included in the image forming apparatus corresponds to the second cycle when the feature image is detected in the cyclic image detecting step, and determining that a state of the rotary member has deteriorated when the cycle depending on the outer circumference is determined to correspond to the second cycle.

20. A control method for determining a state of a rotary member included in an image forming apparatus, the control method comprising:

a step of causing an image forming unit to form an image pattern on a medium, a predetermined image repeatedly appearing in a first cycle in a sub scanning direction in the image pattern;

a step of causing an optical sensor to optically detect a density of the image pattern in the sub scanning direction;

a step of determining whether a feature image having a second cycle corresponding to the first cycle is detected, in accordance with a result of the detection performed by the optical sensor;

a step of determining whether a cycle depending on an outer circumference of the rotary member corresponds to the second cycle, when the feature image is detected in the second cycle; and a step of determining that the state of the rotary member has deteriorated, when the cycle depending on the outer circumference of the rotary member is determined to correspond to the second cycle.

* * * * *